United States Patent [19]

Mitsuya

[11] Patent Number: 4,890,650

[45] Date of Patent: Jan. 2, 1990

[54] DETECTING AND REMOVING FAULTY WEFT IN A JET LOOM

[75] Inventor: Kinpei Mitsuya, Kariya, Japan

[73] Assignee: Kabushiki Kaisha Toyoda Jidoshokki Seisakusho, Kariya, Japan

[21] Appl. No.: 231,086

[22] Filed: Aug. 11, 1988

[30] Foreign Application Priority Data

| | | | |
|---|---|---|---|
| Aug. 25, 1987 | [JP] | Japan | 62-211577 |
| Sep. 16, 1987 | [JP] | Japan | 62-233517 |
| Sep. 18, 1987 | [JP] | Japan | 62-235888 |
| Sep. 21, 1987 | [JP] | Japan | 62-238085 |
| Oct. 26, 1987 | [JP] | Japan | 62-270042 |

[51] Int. Cl.[4] ..... D03D 47/30

[52] U.S. Cl. ..... 139/116 A; 139/435

[58] Field of Search ..... 139/116, 435, 429, 450–452

[56] References Cited

U.S. PATENT DOCUMENTS

| | | | |
|---|---|---|---|
| 4,520,849 | 6/1985 | Suzuki et al. | 139/116 |
| 4,620,570 | 11/1986 | Suzuki | 139/116 X |
| 4,730,643 | 3/1988 | Tamatani | 139/116 |
| 4,781,221 | 11/1988 | Onishi et al. | 139/116 |

*Primary Examiner*—Andrew M. Falik

*Attorney, Agent, or Firm*—Brooks Haidt Haffner & Delahunty

[57] ABSTRACT

An apparatus and its method of operation whereby when a jet loom is deenergized upon occurrence of abnormality in the insertion of a weft, the cutting operation of an inserted weft cutting device is prevented. As a result, a weft succeeding to the misinserted one is forcibly introduced into a weft introducing duct under blowing action of a blow nozzle oriented in a direction intersecting the weft insertion direction to be transferred to a pair of gripper rollers. The weft is separated by cutting from a weft inserting main nozzle by a second weft cutter device. Subsequently, the misinserted weft is withdrawn in the direction away from a cloth fell toward a reed with inclination relative to the weft insertion path within a region where the weft remains out of contact with warps.

8 Claims, 15 Drawing Sheets

DETECTING AND REMOVING FAULTY WEFT IN A JET LOOM

BACKGROUND OF THE INVENTION

1. Field of the Invention

The present invention relates to a method and apparatus for processing a weft suffering abnormal insertion and beaten into woven fabric so as to be removed therefrom.

2. Description of the Prior Art

When abnormal insertion of a weft occurs in a jet loom, operation of the latter is stopped in response to a detection signal outputted from a weft detector and indicating the abnormal weft insertion. In the case of a jet loom operating at a high speed, the loom is stopped only after allowing one or more rotations of the loom crank shaft under inertia. Attempts to stop the loom abruptly are avoided because of the possibility that the components of the loom might be subjected to damaging stress. Consequently, the weft suffering the abnormal insertion (hereinafter referred to as defective or faulty weft) will have been beaten up to a fell of cloth or woven fabric at a time point immediately preceding complete stopping of the jet loom.

In this conjunction, a weft processing apparatus designed for removing such faulty weft as mentioned above which would otherwise involve a defect in the woven fabric is disclosed in Japanese Laid-Open Patent Application Nos. 170556/1987 (JP-A No. 62-170556), 206058/1987 (JP-A No. 62-206058) and 245339/1986 (JP-A No. 61-245339) and Japanese Laid Open Utility Model Application No. 41083/1987 (JP-A No. 62-41083U). In the case of these prior art apparatuses, succeeding insertion of a weft is inhibited when the loom is stopped upon occurrence of the abnormal weft insertion, while a woven weft cutter apparatus disposed in association with a weft inserting main nozzle is simultaneously set to the inoperative state, whereby the faulty weft beaten up to the fell of cloth can be laterally withdrawn for removal from the weft inserting main nozzle by making use of the weft leading to the woven fabric as a clue. More specifically, the weft serving as a clue is introduced not only into a guide cylinder disposed above the weft inserting main nozzle through the medium of a jet stream produced by a blow nozzle, but also into a housing disposed orthogonally to the above-mentioned guide cylinder to be subsequently wound up by a winding apparatus installed within the housing, whereby the faulty weft is withdrawn from the cloth fell to be removed. Thereafter, on the basis of a detection signal produced within a predetermined time by a weft detector mounted inside of the guide cylinder and indicating the presence or absence of the weft, decision is made as to whether the disposal or processing of the faulty weft has been conducted successfully or not. In the case of the arrangement disclosed in JP-A No. 62-170556, the amount of rotation of taking-over or withdrawing rollers provided in a pair is measured by means of a contactless switch, while in the apparatus disclosed in JP-A No. 62-206058, the amount of rotation of a length measuring roller is determined in the similar manner and taken into account in making a decision concerning the disposal of the faulty weft.

It is however noted that the faulty weft being wound up by the weft winder disposed within the housing by way of the guide cylinder is bent approximately at a right angle at an end of an upper group of warps forming a shed. In that case, the bending of the weft encounters resistance of great magnitude and is likely to bring about breakage of the weft on the way to the weft winder. The possibility of such breakage is significantly high in the case of the weft which is relatively feeble by nature. Thus, the ratio of failure in disposing of the faulty weft is increased to lower the operation efficiency of the jet loom, providing an obstacle to the inherently high productivity thereof.

Further, in the case of the apparatus disclosed in JP-A No. 62-170556 and JP-A No. 62-206058, there are required detecting and/or measuring means such as a rotary encoder, contactless switch, a timer or the like for detecting the amount of rotation of a winder driving motor or the roller in conjunction with the decision concerning the result of the weft disposal operation. Apparently, the presence of such measuring means will increase the ratio at which erroneous operation takes place because of false measurement. By way of example, decision of the unsuccessful weft disposal may be made notwithstanding of the successful operation and vice versa. Such erroneous decision will result in the unnecessary shut down or stoppage of the loom, leading to lowering of the operation efficiency thereof or such inconvenience that the faulty weft is left in the shed formed by the warps.

As the detector for detecting the presence or absence of the weft in the guide cylinder within a predetermined time, there is commonly employed a photoelectric type weft detector. Further, in the apparatus disclosed in Japanese Laid-Open Utility Model Application No. 46676/1987 (JP-A No. 62-46676), such arrangement is adopted in which a weft detector provided with a rotatable detecting arm is translated, following up the movement of one of the paired weft taking-over rollers for engaging the other under pressure, wherein the rotatable detecting arm sweeps transversely the weft transfer path.

The photoelectric weft detecting device is however disadvantageous in that vibration of the weft being transferred to the weft taking-over means may bring about error, degrading the accuracy at which the absence or presence of the weft is detected, which in turn increases undesirably the probability of the erroneous decision concerning the disposal of the weft. In the case of the mechanical weft detecting operation with the aid of the rotatable detecting arm, degradation in accuracy of detection due to the vibration of the weft can certainly be avoided. However, in the translation type detection system in which the detecting member of the weft detector is caused to move in parallel in accompanying the movement of the gripping rollers, the detecting arm has to perform the sweeping operation across the relatively wide weft transfer path wholly. In that case, the range in which the detecting arm can be rotated may be restricted or narrowed under constraint exerted by the weft engaging the detecting arm, which will possibly result in that ON/OFF operation of the weft detector can no more be effectuated notwithstanding the presence of the weft.

Besides, in the apparatus disclosed in JP-A No. 61-245339 and JP-A No. 62-41083U mentioned above, the jet stream produced by the blow nozzle and directed to the guide cylinder can not be avoided from diffusion, lowering the reliability of introducing into the guide cylinder the weft that follows the faulty one, and resulting in frequent failure in transferring the weft from the blow nozzle to the weft winder. As a result, the probability of unsuccessful processing or disposal of the faulty weft is increased, leading to lowered operating efficiency and making it difficult to attain the high yield otherwise afforded by the jet loom. Additionally, although the blow nozzle for blowing the weft toward the guide cylinder, and the weft inserting main nozzle, are mounted in fixed relative position to ensure positive prevention of the weft insertion, the weft inserting main nozzle and the guide cylinder are moved relative to each other during inertial operation of the loom occuring subsequently to detection of the faulty weft insertion. This is due to the fact that the guide cylinder for introducing the succeeding weft to serve as the clue for withdrawing the faulty weft, is fixedly mounted on the base portion of the loom. Consequently, reliability can not be assured in the transfer of the weft between the weft inserting main nozzle and the inlet port of the guide cylinder, resulting in an increase in the probability of failure in the disposal of a faulty weft.

Further, with the arrangement in which the tip portion of the weft is introduced into the housing disposed approximately orthogonally to the direction in which the weft is delivered from the guide cylinder, as disclosed in JP-A No. 61-245339 and JP-A No. 62-41083U, introduction of the weft to the weft winder can not be realized positively, involving high ratio of failure in the transfer of the weft from the taking-up means to the winder. As a result, the ratio of failure in the disposal of the faulty weft is increased, preventing the inherent high productivity of the jet loom from being fully achieved.

As is apparent to those skilled in the art, there exists thus a need for the faulty weft disposal method and apparatus which are substantially immune to the shortcomings of the prior art elucidated above.

SUMMARY OF THE INVENTION

According to an aspect of the present invention, there is provided a method of disposing of a faulty weft in a loom in which the cutting operation of a woven weft cutter means for separating by cutting a normally inserted weft from a weft inserting main nozzle upon every beating is temporarily prevented when operation of the loom is stopped upon occurrence of abnormality in insertion of the weft. This enables the next succeeding weft (yarn), still connected to the weft that has undergone abnormal insertion, to be forcibly introduced into a weft introducing duct under blowing action of a blow nozzle. This is accomplished in a direction intersecting the weft inserting direction and transports the succeeding weft to mechanical weft taking-over or taking-up means. Thereafter the weft introduced forcibly into the weft introducing duct is separated by cutting from the weft inserting main nozzle by a cutter for that purpose. The faulty weft is subsequently inclined relative to the normal weft insertion path by the abovementioned weft taking-over means within a region in which the faulty weft is out of contact with warps and is then withdrawn in such a direction that the weft is moved away from the cloth fell toward a reed.

According to the weft disposal method mentioned above, the succeeding weft serving as a clue for withdrawing the faulty weft (i.e. weft inserted abnormally) is introduced into the weft introducing duct through the medium of an air jet produced by the blow nozzle to undergo the mechanical taking-over or taking-up action of the weft taking-over means. The weft transferred to the weft taking-over means is inclined relative to the weft insertion path within the region where no contact with the warp takes place and withdrawn through the shed formed by the warps in the direction to move away from the cloth fell. Resistance accompanying this withdrawal of the weft is given only by the gripping force effective between upper and lower groups of the warps defining the shed. Accordingly, the resistance encountered in withdrawing the faulty weft is of very small magnitude, which means that the probability or ratio of breakage of the weft in the course of being withdrawn is significantly reduced, while the ratio of successful withdrawal of the faulty weft is significantly increased.

In a preferred mode of carrying out the faulty weft disposal method according to the present invention, it is proposed that upon occurrence of abnormality in the weft insertion, a weft succeeding to the faulty weft is maintained in the state connected to the latter, while the succeeding weft jetted from the weft inserting main nozzle is carried to the weft taking-over means through the medium of a jet air stream ejected from the blow nozzle, wherein a stepping motor for rotating a driving roller constituting a part of the weft taking-over means in cooperation with a driven roller pressed detachably against the driving roller for gripping the weft under pressure is rotated a predetermined number of steps. Thereafter, the presence or absence of the weft on the aforementioned transfer path is detected. When absence of the weft is detected, it is decided that the weft disposal has been unsuccessful.

The succeeding weft providing the clue for withdrawing the faulty weft from the cloth fell is transferred to the weft taking-over means mentioned above, which transfer is accompanied with withdrawal of the faulty weft from the cloth fell laterally through the shed formed by the warps. The weft detector disposed on the transfer path along which the weft is withdrawn by the taking-over means detects presence or absence of the weft after the stepping motor has been rotated the predetermined number of steps. When the detection has resulted in the absence of the weft, it is decided that the weft disposal has ended unsuccessfully. In this connection, it should be noted that the measuring means for determining the amount of rotation of the motor, driving roller or the like is rendered unnecessary in conjunction with the decision concerning the successful or unsuccessful disposal of the faulty weft according to the teaching of the present invention, whereby erroneous operation bringing about false decision concerning the successful or unsuccessful weft disposal can be suppressed satisfactorily.

According to another aspect of the present invention, there is provided an apparatus for disposing of a faulty weft in a loom, which apparatus comprises weft cutting preventing means for preventing cutting operation of woven weft cutter means serving for separating by cutting an inserted normal weft upon every beating by a reed, when operation of the loom is stopped upon abnormal weft insertion, a weft introducing duct installed laterally of the weft inserting main nozzle, a blow nozzle inserting the weft jetted from the weft inserting main nozzle by blowing the weft to the weft introducing duct, weft taking-over means for taking over the weft from the weft introducing duct, and cutter means for separating the weft transferred to the weft taking-over means by cutting the weft from the weft inserting main fiozzle, wherein inlet port of the weft introducing duct is so disposed as to be inclined relative to a weft insertion path within a region in which warps defining a shed remains without contacting the weft and define a weft withdrawal path in the direction away from a cloth fell.

In a preferred embodiment of the faulty weft disposal apparatus according to the present invention, the weft taking-over means is constituted by a pair of detachably engageable driving and driven rollers for gripping the weft under pressure upon engagement of the rollers, wherein there is further provided weft detecting means rotatable in interlocking with the engaging operation of the weft taking over means, which weft detecting means is provided with a rotatable weft detecting arm for rotationally sweeping the weft transfer path transversely thereof upon engaging operation of the rollers constituting the weft taking-over means.

The succeeding weft serving as the clue for withdrawing the faulty weft from the cloth fell is withdrawn by the mechanical weft taking-over means mentioned above, whereby the faulty weft located at the cloth fell is withdrawn laterally through the warp shed. The weft detector is rotated, accompanying the movement of the driving roller constituting a part of the weft taking-over means for gripping the weft under pressure, whereby the rotatable detecting arm of the weft detector sweeps over and across the weft transfer path along which the weft is transferred to the weft taking-over means. When the weft is present in the weft transfer path, the rotational sweeping operation of the detecting arm is inhibited, resulting in that the rotatable detecting arm is rotated relative to the main body of the weft detector. This relative rotation of the detecting arm is realized in the form of the relative rotation of the main body of the weft detector. Accordingly, the range in which the detecting arm can be rotated relative to the main body of the weft detector notwithstanding of engagement of the weft gripping rollers covers the ON/OFF switching position of the weft detector with a sufficient margin, whereby detection of the weft can be accomplished with an enhanced accuracy.

In a further preferred embodiment of the present invention, a blow guide is installed across the weft insertion path between the aforementioned weft introducing duct and blow nozzle. The air stream jetted from thee blow nozzle effective for blowing the succeeding weft serving as the clue for withdrawing the faulty weft from the cloth fell is guided into the weft introducing duct through the blow guide, whereby the weft carried by the air stream jetted from the blow nozzle is positively directed into the weft introducing duct. Consequently, the mechanical transfer of the succeeding weft to the weft taking-over means can be carried out smoothly, whereby the ratio of withdrawing and removing the faulty weft successfully is increased.

According to another preferred mode of carrying out the present invention, a jet orifice of the blow nozzle and an inlet port of the weft introducing duct are installed on both sides of the weft insertion path invariably in respect to the position relative to the weft inserting main nozzle.

With the arrangement described above, the jet orifice of the blow nozzle and the inlet port of the weft introducing duct can be kept in the invariable relative position across the jet air path of the weft introducing main nozzle, whereby the direction in which the weft is jetted from the blow nozzle can be made to coincide constantly with the inlet port of the weft introducing duct, while the distance between the jet orifice and the inlet port can be shortened as far as possible. Thus, the succeeding weft serving as the clue for withdrawing the faulty weft beaten to the cloth fell can be positively introduced into the introducing duct from the blow nozzle by the air jet therefrom even in the course of operation of the loom. The weft then undergoes the positive withdrawal operation o the weft taking-over means after the stoppage of the loom, whereby the ratio of the successful withdrawal of the faulty weft is significantly increased.

The faulty weft disposal apparatus according to the present invention may include a second blow nozzle for directing the weft toward the weft taking-over means within the weft introducing duct. With this arrangement, the succeeding weft providing the clue for the withdrawal of the faulty weft and guided into the weft introducing duct can be blown to the weft withdrawing rollers or other withdrawing means such as the weft winder or the like due to the provision of the second blow nozzle. Consequently, transfer of the succeeding weft to the mechanical taking-over action of the weft taking-over means from the blowing action for introducing the succeeding weft into the weft guiding means can be realized smoothly, whereby the ratio of successful withdrawal of the faulty weft is significantly increased.

BRIEF DESCRIPTION OF THE DRAWINGS

The present invention will become more readily apparent from the following description of the preferred embodiments thereof shown, by way of example only, in the accompanying drawings, in which like reference characters designate like or corresponding parts, and wherein.

DESCRIPTION OF THE PREFERRED EMBODIMENTS

In the following, exemplary embodiments implementing the teachings of the present invention will be described in detail with reference to the accompanying drawings.

Figure 1:
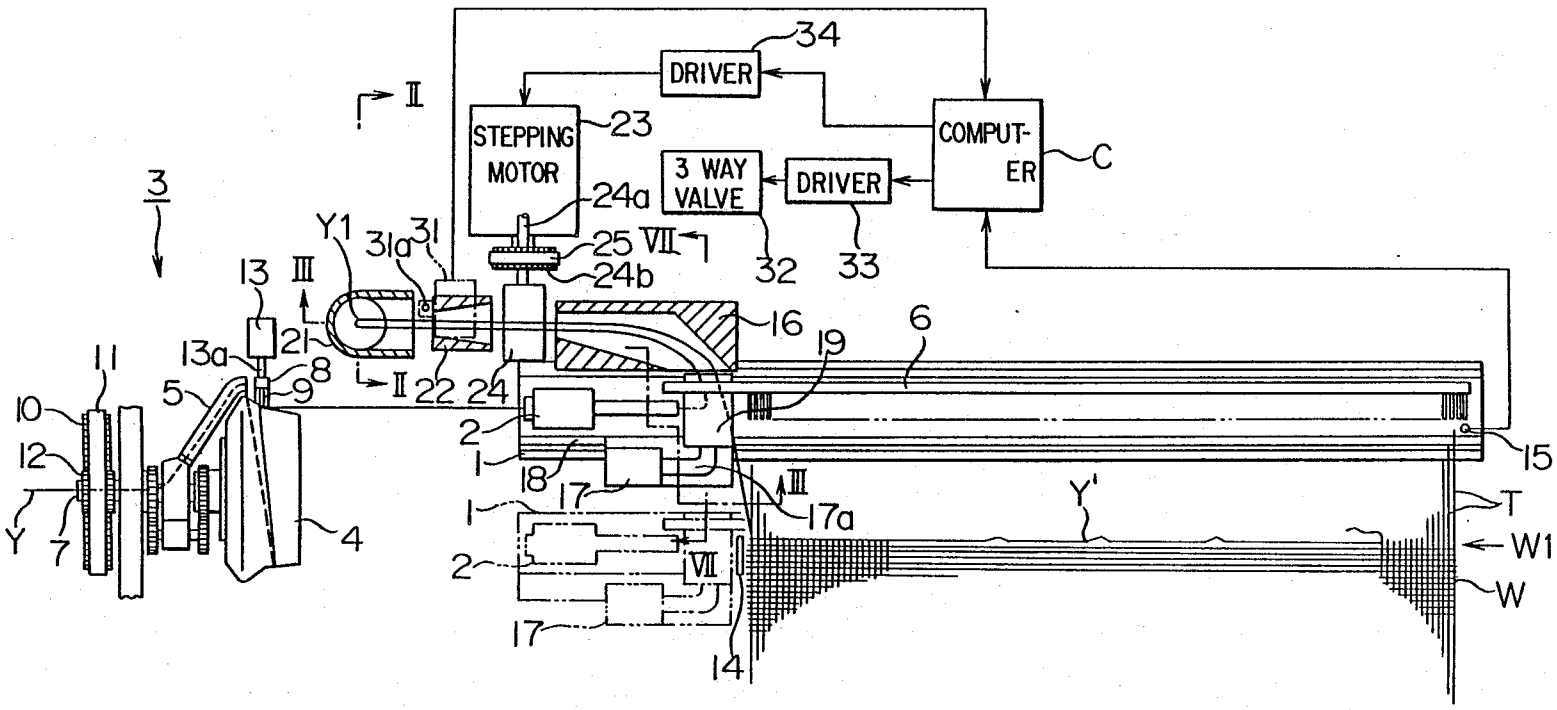
FIG. 1 is a schematic plan view showing partially in section an embodiment of a faulty weft processing apparatus incorporating therein the present invention.

Referring to FIG. 1, a weft inserting (or picking) main nozzle 2 is disposed on a sley 1 at one end thereof. A weft Y supplied through a weft winding tube 6 and wound around a drum 4 defining a weft winding surface of a weft length measuring and storing assembly 3 is introduced into the weft inserting main nozzle 2 to be jetted into a weft guide passage (FIG. 6) of a modified reed 6 disposed vertically on the sley 1 from the weft inserting main nozzle 2 in synchronism with the weft insertion timing.

The weft winding tube 5 is mounted on a rotatable supporting conduit 7 for holding stationarily the drum 4 in a manner to allow relative rotation between the tube 5 and the drum 4, wherein the weft Y fed into the rotatable supporting conduit 7 from a cheese (not shown) is guided to the weft winding tube 5. Withdrawal of the weft from the drum 4 is controlled by intersection (engagement) and detachment (disengagement) of a weft retaining member 9 mounted on a pivotably supported cam lever 8 at one end thereof with and from the weft winding surface of the drum 4. The pivotal motion of the cam lever 8 is effectuated under the action of a cam (not shown) mounted on a driving shaft (also not shown) which is rotationally driven in sychronism with the operation of the loom. The rotation of this driving shaft is transmitted to the rotatable supporting conduit 7 by way of a timing pulley 10, a timing belt 11 and another timing pulley 12, wherein the weft Y is dispensed to be wound onto the drum 4 through the weft winding tube 5 in the course of its revolution around the drum 4.

An electromagnetic solenoid 13 is installed above the cam lever 8 in the vicinity of one end thereof, while a driving rod 13*a* of the electromagetic solenoid 13 is installed in such orientation to face toward the cam level 8. In the state in which the driving rod 13 of the solenoid 13 is projected, the free end of that rod 13*a* bears against the cam lever 8 at one end thereof under pressure, as the result of which the weft retaining member 9 is held in the state intersecting or engaging the weft winding surface of the drum 4 mentioned above. In this manner, the weft length measuring and storing assembly 3 and the electromagnetic solenoid 13 cooperate with each other to constitute a weft insertion inhibiting mechanism.

When the weft Y jetted from the weft inserting main nozzle 2 has been correctly inserted and has reached the end of a woven cloth W located on the side opposite to the main nozzle 2, the weft is beaten up to a cloth fell W1 of the woven cloth or fabric W by means of a modified reed 6 with a weft guide path formed therein. Subsequently, the weft as beaten up is cut off by a woven weft cutting device of electromagnetic type disposed on the same side as the weft inserting main nozzle 2, being followed by the succeeding weaving operation in succession.

When abnormality in the weft insertion such as failure of the weft in reaching the end of the cloth on the side opposite to the weft inserting main nozzle 2 has taken place, a feeler 15 disposed at an appropriate position on the opposite side detects the failure in the insertion of weft to thereby produce a weft insertion failure signal. In response to this detection signal from the feeler 15, a loom control computer C commands the shutdown or stoppage of operation of the loom. In practical application, however, the loom crank shaft (not shown) will continue to rotate about one revolution under inertia before being stopped in response to the the weft insertion failure detection signal. More specifically, the weft insertion failure detection signal is produced during a period in which the sley 1 moves forwardly toward the woven fabric W from the most retracted position indicated by a solid line in FIG. 1, whereby the faulty weft Y' to be disposed of is once beaten up to the woven fabric W. Thereafter, the sley 1 is moved back reciprocatively to the position located immediately before the beating position indicated by a dotted line in FIG. 1. At the same time, the loom control computer C inhibits the weft cutting operation of the woven weft cutting device 14 in precedence to the time point at which the faulty weft Y' would otherwise be cut. As a consequence, the faulty weft Y' beaten to the cloth fell W1 of the woven fabric W is maintained connected to the weft remaining within the inserting main nozzle 2. In this connection, however, it will be readily appreciated that the inhibition of breakage of the weft can also be assured by displacing the weft outside of the operative region of the weft cutting device with the aid of other suitable means.

Disposed behind and in the vicinity of the weft insertion path of the weft inserting main nozzle 2 as viewed in the state in which the sley 1 is located at the most retracted position is a weft introducing duct t16 of a linear form so as to extend substantially in parallel with the weft inserting direction, while a blow nozzle 17 connected to a blower unit (not shown) is mounted on a supporting base 18 disposed on the sley 1 on the opposite side to the weft introducing duct 16 such that the weft insertion path mentioned above extends between the weft introducing duct 16 and the blow nozzle 17. The blow nozzle 17 is provided with a jet tube 17*a* having an end portion bent toward the weft introducing duct 16, wherein a blow guide 19 substantially of a C-like shape is fixedly mounted on the bent end portion of the jet tube 17*a* so as to confine the weft insertion path within the blow guide 19 in respect to the vertical position thereof. The weft jetted or ejected from the weft inserting main nozzle 2 can be fed into the weft introducing duct 16 under the action of air stream produced between the blow nozzle 17 and the weft introducing duct 16. The weft thus blown in the weft introducing duct 16 can be cut by a stationary blade 20 to be thereby separated from the weft inserting main nozzle 2. The stationary blade 20 is mounted fixedly across the free ends of the C-like blow guide 19.

Disposed in opposition to the exit of the weft introducing duct 16 to the left side thereof as viewed in the figure is a suction duct 21 connected to a suction system (not shown), while an air guide 22 is interposed between the suction duct 21 and the weft introducing duct 16. A stepping motor 23 is disposed below and between the air guide 22 and the weft introducing duct 16. Additionally, a driving roller 24 is disposed immediately above the stepping motor 23. A driving pulley **23*a* coupled to the stepping motor 23 is operatively connected to a driven pulley 24*b* mounted on a supporting shaft 24*a* of the driving roller 24 through a timing belt 25**.

An air cylinder 26 is disposed above the driving roller 24 in such orientation that the longitudinal axis thereof extends vertically, while a driven roller 28 is disposed in opposition to the driving roller 24 and is supported rotatably in a supporting frame 27 which is fixedly secured to a driving rod **26*a* of the air cylinder 26 at the protruding end thereof so that the driven roller 28 can be pressed against the driving roller 26 when the driving cylinder rod 24*a* is projected outwardly from the air cylinder 26. A supporting shaft 29 extending laterally from the air cylinder 26 supports rotatably a plate-like supporting member 30 suspended vertically downwardly, wherein a guide bore 30*a* formed in the lower end portion of the plate-like member 30 is adapted to slidably receive therein a guide pin 27*a* which is fixedly mounted on the supporting frame 27 and projects laterally therefrom. A weft detector 31 of a limit switch type is mounted on the supporting plate 30 and includes a detecting or sensor arm 31*a* which is so supported as to sweep transversely a weft transfer path defined between the air guide 22 and the suction duct 21**.

The detection signal outputted from the weft detector 31 is received by the weft processing control computer C. As described hereinbefore, this computer C responds to the weft detection signal produced by the feeler 15 by issuing operation commands to driver circuits 33 and 34 provided in association with a three-way solenoid valve 32 and the stepping motor 23, respectively. The weft processing computer C arithmetically determines and stores the number of steps N that the stepping motor 23 has to execute on the basis of the input data representative of the width of the woven fabric W, i.e. the length of the faulty weft Y' to be withdrawn, whereupon a command pulse signal representative of the arithmetically determined step number N is supplied to the stepping motor 23.

Now, it is assumed that failure occurs in the insertion of weft, then the jet of the weft inserting main nozzle 2 is stopped, while the operation of the woven weft cutting device 14 is inhibited with the sley 1 being stopped at the position indicated by the dotted line in FIG. 1. Consequently, a weft Y1 connected to the faulty weft Y' is prevented from being inserted. On the other hand, the faulty weft Y' has been beaten to the cloth fell W1 while operatively coupled to the weft inserting main nozzle 2. In response to the weft insertion failure detecting signal produced by the feeler 15, the weft processing control computer C is set to the state ready for reception of the signal produced by the weft detector 31, while the blower and suction systems (not shown) mentioned hereinbefore are activated under the command of the loom control computer C, as the result of which an air stream transversing the weft insertion path is produced between the blow nozzle 17 and the weft introducing duct 16. In the interval between the detecting of failure in the weft insertion and the stoppage of the loom, the weft retaining member 9 is once moved away (separated) from the drum 4 and caused to again intersect or engage the drum 4. The state of intersection is maintained through energization of the solenoid 13 under the command of the loom control computer C. By virtue of the abovementioned separation of the weft retaining member 9 from the drum 4, the weft Y1 of the amount corresponding to the single insertion is stored on the drum 4 in the state ready for being pulled out and subsequently is forcibly guided into an inlet port **16*b* of the weft introducing duct 16. All the weft Y1 wound on the drum 4 is withdrawn to be fed into the weft introducing duct 16 in the course of time lapse before the loom is stopped. Subsequently, the loom is rotated reversely while the sley 1** is retracted to the most retracted position. Thus, the shedding of the warps T is established which releases the faulty weft Y' from the condition wherein it was trapped between the upper and lower warps T.

Figure 4:
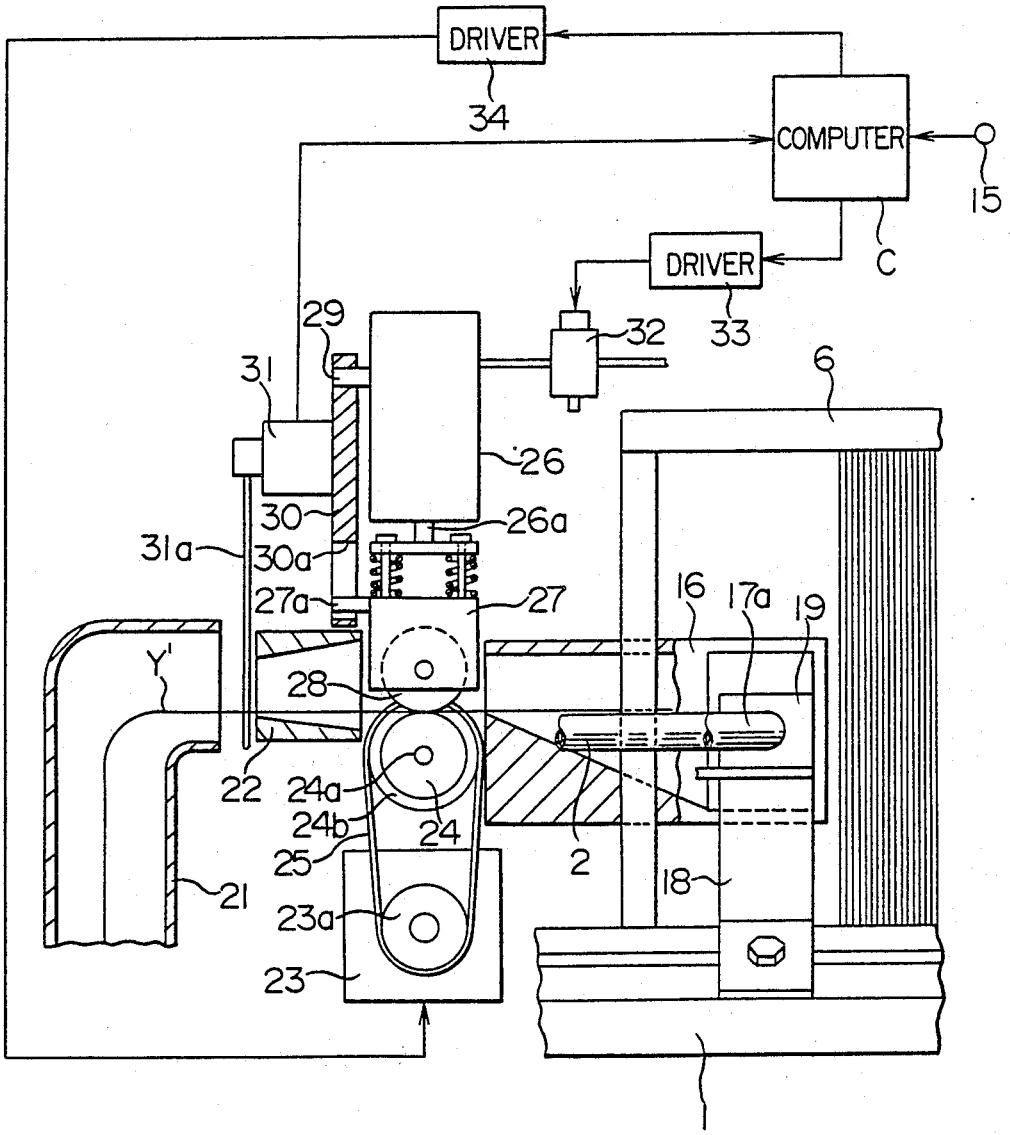
FIG. 4 is a view similar to FIG. 3 and shows a state in which a driving roller constituting a part of weft take-over means is brought into contact with a couterpart driven roller.

The weft Y1 forcibly fed into the weft introducing duct 16 is guided with deflection toward the exit or outlet port of the weft introducing duct 16 under guiding action by the internal passage formed in the duct 16 to be ejected from the exit of the weft introducing duct 16. The bent tip portion of the weft Y1 ejected from the exit of the weft introducing duct 16 will reach the suction duct 21 by way of the air guide 22 before the the loom is stopped. The weft processing control computer C issues an activating signal to the three-way solenoid valve 32 subsequent to the reverse rotation of the loom. As a consequence, the driven roller 28 is pressed against the driving roller 24, as is shown in FIG. 4, resulting in that the weft Y1 is gripped under pressure between the rollers 24 and 28. As the driven roller 28 is moved downwardly, the supporting plate member 30 is tilted from the position indicated by the solid line to the position indicated by the dotted line in FIG. 2 due to the sliding engagement between the guide pin **27*a* and the guide hole 30*a* , while the detecting arm 31*a* sweeps transversely the transfer path of the weft Y1. Thus, the detecting arm 31*a* is caused to rotate relative to the main body of the weft detector 31 by the weft Y1 tensioned between the paired rollers 24 and 28 and the suction duct 21, whereby the detection signal indicating the presence of the weft is issued to the weft processing control computer C from the weft detector 31**.

The weft processing control computer C responds to the detection signal produced by the weft detector 31 and indicating the presence of the weft by outputting an operation command to the stepping motor 23 for rotation g the latter a set number N of steps. Thus, the stepping motor 23 is rotated for an angular distance corresponding to the number N of steps to thereby rotate the driving roller 24 and the driven roller 28 correspondingly with the weft Y1 gripped between these rollers 24 and 28. As the weft Y1 is fed to the suction duct 21 through rotation of both rollers 24 and 28, the tensioned weft Y1 is cut to be separated from the weft inserting main nozzle 2 by means of the stationary blade or knife edge 20 (FIG. 2), while the faulty weft Y' located at the cloth fell W1 is also separated therefrom.

The amount of peripheral rotation of the driving roller 24 and the driven roller 28 corresponding to the step number N is so determined as to correspond to a sum of the length of the weft Y1 extending through the weft introducing duct 16 to the end of the cloth fell W1 on the side of the woven weft cutter 14 (FIG. 1) and the width of cloth. Upon completion of rotation of the stepping motor 23 corresponding to the step number N without bringing about breakage of the weft in the course of removal of the faulty weft Y', the tip portion of the faulty weft Y' becomes located interiorly of the weft introducing duct 16, as is shown in FIG. 4, being left under tension between the paired rollers 24 and 28 and the suction duct 21. Accordingly, the weft detector 31 issues the detection signal indicative of the presence of the weft to the weft processing control computer C, which then decides that the weft processing or disposal has been performed successfully on the basis of the information indicating the presence of the weft upon completion of the stepwise rotation of the stepping motor 23 for the number N of steps. Subsequently, the weft processing control computer C issues a command pulse signal indicative of a predetermined number n of rotation steps to be excuted by the stepping motor 23 succeedingly.

The amount of rotation of the stepping motor required for withdrawing the faulty weft Y' for the complete removal thereof from the warp shed depends only on the present number N of the steps. Thus, the length of the weft as withdrawn by the paired rollers 24 and 28 can be determined without resorting to any measurement. In this manner, decision can be made with reliability as to whether the weft could be disposed of successfully or not without need for provision of measuring means such as a rotary encoder for measuring the rotation of the motor for driving the roller 24, a contact switch for measuring the rotation of the driving roller 24 itself, a timer for measuring the operating duration of the motor for actuating the driving roller 24 or the like which may eventually involve error in the result of measurement. Further, by setting properly the number of pulses of the command pulse signal per unit time, the rotational speed of the stepping motor can be arbitrarily and selectively established, which in turn means that speed control can be performed in such a manner that the speed of withdrawing the weft is decreased when it is of small strength while increased for weft of greater strength.

Figure 2:
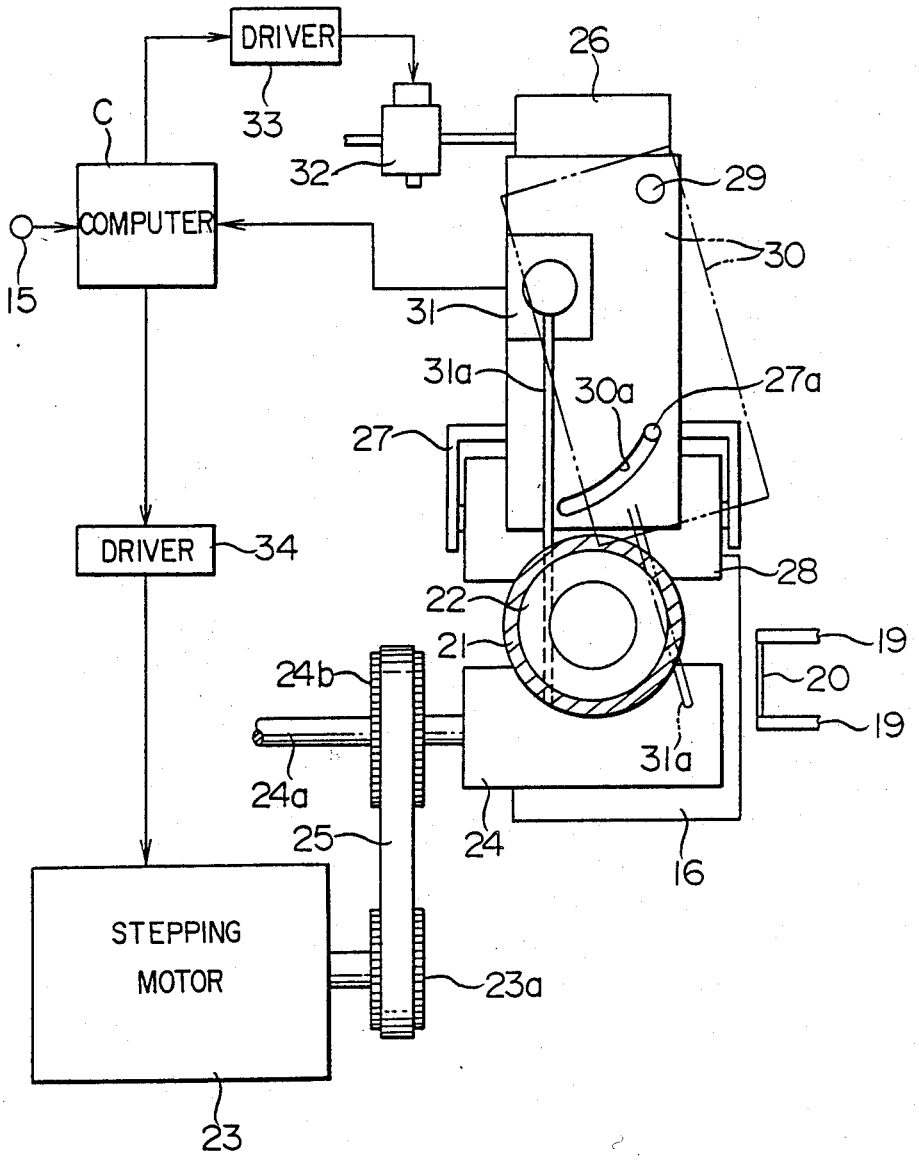
FIG. 2 is an enlarged elevational view taken along a line II—II in FIG. 1.
Figure 3:
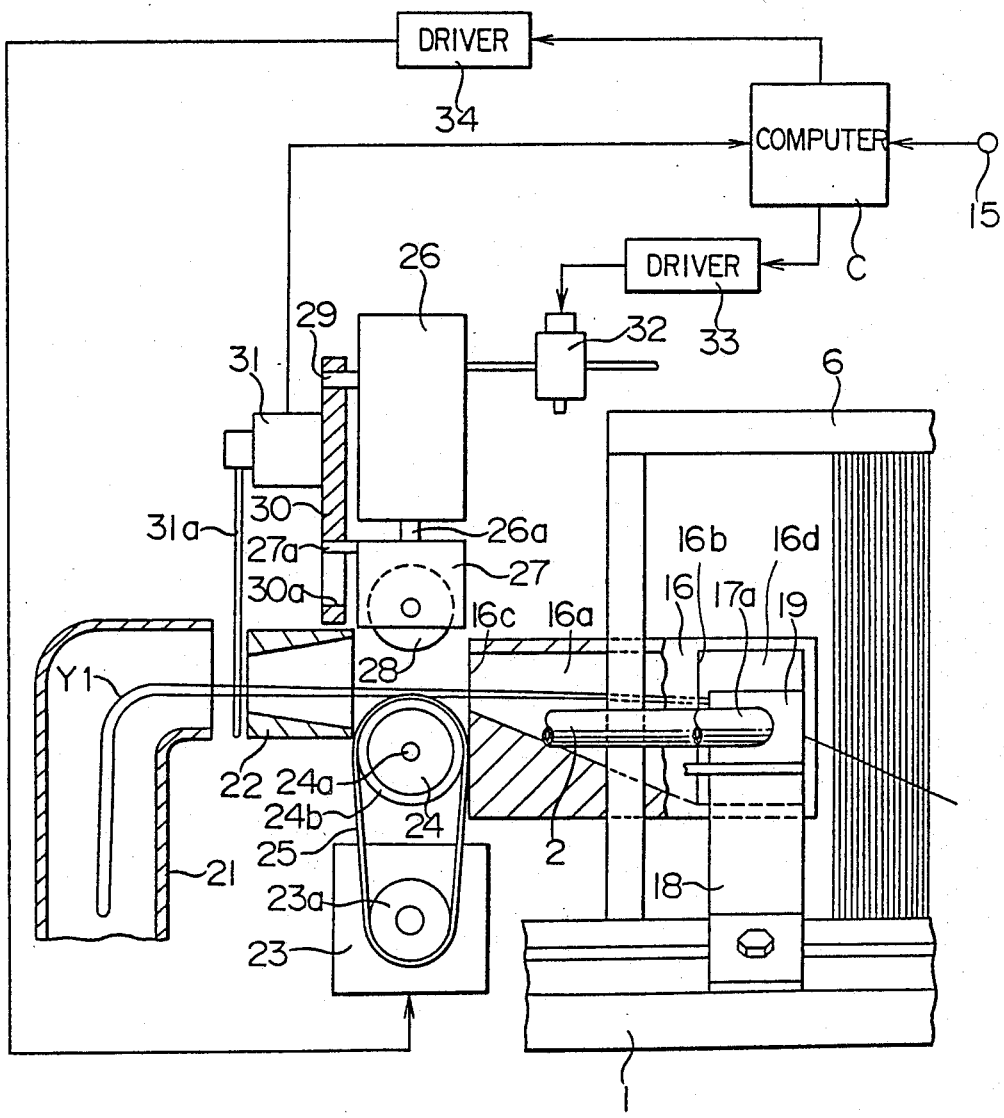
FIG. 3 is an enlarged sectional view taken along a line III—III in FIG. 1.

When all the remaining portion of the faulty weft Y', withdrawn from the shed formed between the warps, has passed through the paired rollers 24 and 28, the detecting arm 31*a* of the weft detector 31 is rotated from the position indicated by the solid line in FIG. 2 to the position indicated by the dotted line, whereupon the weft detector 31 produces a detection signal indicating the absence of the weft to the weft processing control computer C. When the detection signal indicating the absence of the weft is received by the weft processing control computer C in the course of operation of the stepping motor 23 performed in response to the rotation command for the number n of steps, it is decided that the disposal of the remaining portion of the faulty weft Y' has been accomplished successfully, whereupon a signal for restarting the loom is issued by the control computer C. Unless the signal indicating the absence of the weft is received during the operation of the stepping motor triggered in response to the command for stepwise rotation by the step number n, decision is then made that the disposal or processing of the remaining portion of the faulty weft Y' has failed. In that case, the computer issues a display command indicating the failure in processing the remaining faulty weft to a display unit (not shown) without producing the loom restart signal. By virtue of the detection of the presence or absence of the faulty weft Y' in conjunction with the disposal of the remaining weft portion, situation which may exert influence to the decision concerning the weft processing such as erroneous operation of the weft detector 31 itself or entangling of the weft around the detection arm 31*a* can also be detected. In this case, the duration of operation of the stepping motor 23 for disposing of the remaining weft portion can also be controlled by using a timer, because rotation of the stepping motor to this end can be performed without requiring accuracy in the measurement of the length.

It goes without saying that the present invention is never restricted to the embodiment described above. By way of example, the limit switch type weft detector 31 may be replaced by a photoelectric weft detector, which may then be installed within the air guide 22 or the weft introducing duct 16. In that case, when the decision made upon completion of the N steps of rotation of the stepping motor has proven that the withdrawal of the faulty weft Y' from the opening between the warps was successful, operation of the loom may be immediately restarted. On the other hand, when the disposal of the remaining weft has failed, the causes for the failure can be eliminated during the operation of the loom. Besides, instead of inputting the width of cloth, the step number N may be directly inputted. Similarly, angle of rotation may alternatively be inputted. Further, by interposing an appropriate transmission gear between the stepping motor 23 and the driving roller 24 to thereby increase the set number N of steps, it is possible to control more finely the rotation of the stepping motor 23. It should also be mentioned that the present invention is equally applicable to the removal of the weft inserted immediately before the stoppage of the loom for the purpose of preventing formation of offset or barred which otherwise may occur. above.

In the case of the exemplary embodiment described above, the weft presence indicating detection signal produced by the weft detector 31 which serves as a trigger signal for the weft processing control computer C is generated when the detection arm 31*a* rotatable relative to the main body of the weft detector 31 moves from the position of the origin located in an OFF region into an ON region after having moved through the OFF-ON switch position. In this connection, it is noted that since the body of the weft detector 31 itself can also be rotated around the supporting shaft 29, the range in which the tip portion of the rotatable detecting arm 31*a* is rotated, accompanying the rotation of the body of the weft detector, may cover sufficiently the weft withdrawing path even of a relatively large width with a margin. Accordingly, the range of the relative rotation of the rotatable detecting arm 31*a* relative to the body of the weft detector 31 due to engagement with the weft Y1 existing on the weft withdrawal path extending between the air guide 22 and the suction duct 21 can cover the OFF-ON switch position with a margin, whereby the rotatable detecting arm 31*a* can be changed over to the ON state without failure from the OFF state corresponding to the origin in the OFF region after having passed through the ON-OFF switch position. In other words, so long as the weft Y1 is present on the path or route for the weft withdrawal extending between the air guide 22 and the suction duct 21, the detection signal indicating the presence of the weft is outputted from the weft detector 31 without failure, whereby the succeeding weft processing (disposal) operation can be performed smoothly.

In the similar manner, detection of presence or absence of the remaining tip portion of the faulty weft Y' can be positively realized, whereby transition to the loom restart operation can be accomplished in order.

Figure 5:
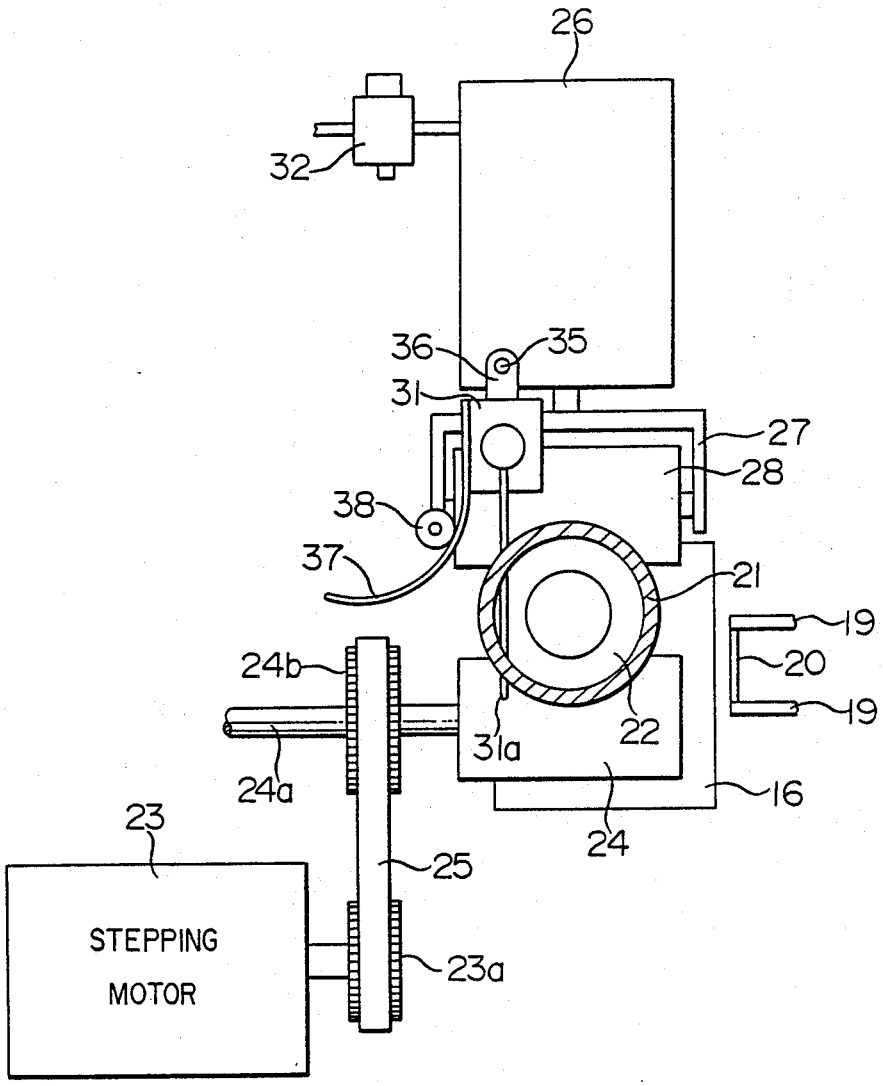
FIG. 5 is a view similar to FIG. 2 and shows a modification of a weft detecting device employed in the processing apparatus shown in FIGS. 1 to 4.

Of course, the present invention is not restricted to the abovementioned arrangement. By way of example, a supporting lever 36 may be rotatably mounted on a supporting shaft 35 projecting from the air cylinder 26, while the weft detector 31 may be mounted on the supporting lever 36, wherein an arcuate guide member 37 can be mounted on a side wall of the body of the weft detector 31 so as to be engaged by a roll member 38 mounted on the supporting frame 27 of the driven roller 28, as is shown in FIG. 5. In this arrangement, the supporting lever 36 may be resiliently urged toward the roll member 38 by means of a spring not shown. The rotatable detecting arm 31*a* can then perform the rotational sweeping operation in the manner described hereinbefore due to the engagement between the roll member 38 and the arcuate guide member 37 which is brought about upon downward movement of the driven roller 28.

In the embodiments described above, the center of rotation of the weft detector 31 is located distanced slightly from the main body of the weft detector 31. It will however be understood that by locating the center of rotation so as to coincide with the center of rotation of the detection arm 31*a* rotatable relative to the body of the weft detector 31, the accuracy for detecting the weft can further be enhanced. Of course, the present invention can be applied to the processing or disposal for removing the weft inserted immediately before the stoppage of the loom, for thereby preventing the barred from being formed upon stopping of the loom.

In the case of the embodiment described above, the weft introducing duct 16 disposed in opposition to the blow nozzle 17 across the weft inserting path is formed at the front face thereof with an introducing opening 16*b* for the associated guide passage 16*a* while an outlet or exit 16*c* is formed in the upper left end portion of the weft introducing duct 16, as will be seen in FIGS. 1, 3, 6 and 7. Further, an inclined guide surface 16*d* is formed on the rear wall of the guide passage 16*a* in the vicinity of the inelt opening 16*b* so that the air flow crosssection of the guide passage 16*a* is progressively decreased toward the exit 16*c*.

Figure 6:
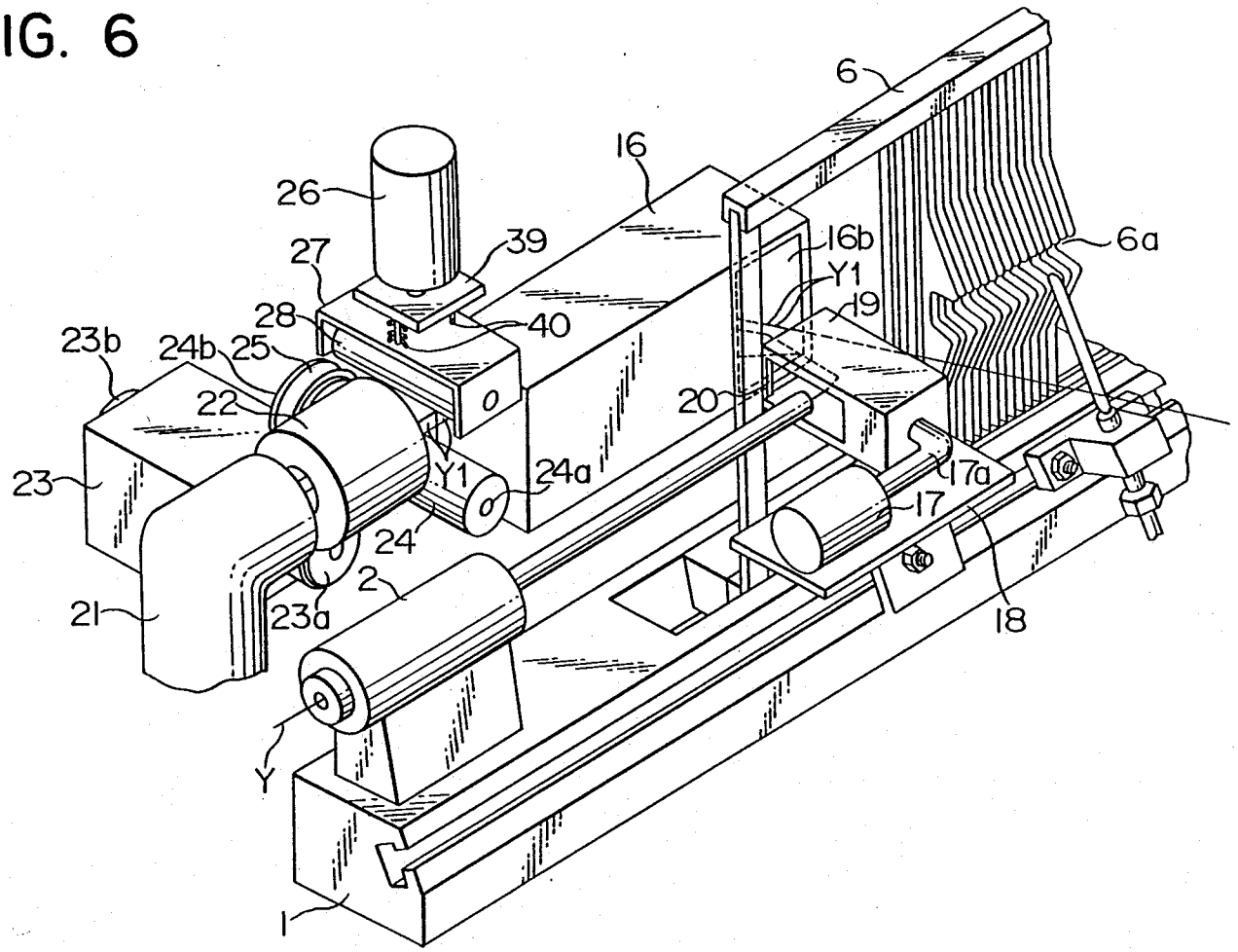
FIG. 6 is a perspective view showing a main portion of the faulty weft processing apparatus shown in FIG. 1.
Figure 7:
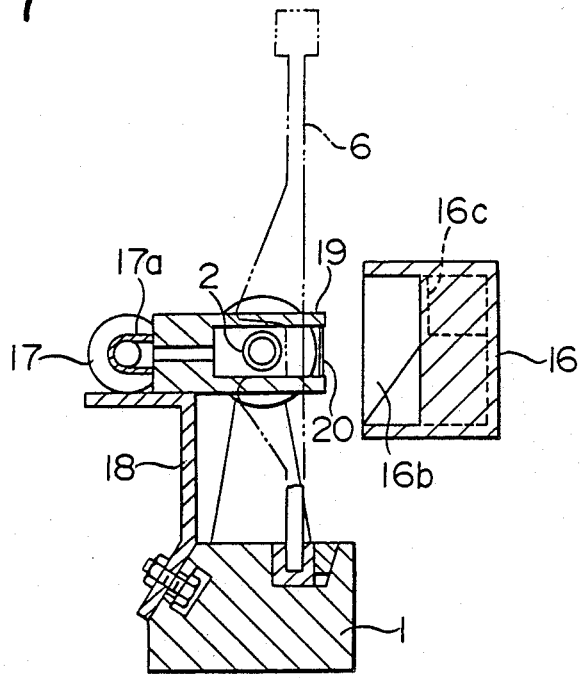
FIG. 7 is a sectional view taken along a line VII—VII in FIG. 1 in a plane extending through a weft introducing duct, a blow guide and a blow nozzle.

Although not shown in FIGS. 1 to 4, the roller supporting frame 27 may be supported vertically slidably on the supporting plate 39 mounted on the protruding end of the driving rod of the air cylinder 26, wherein the supporting frame 27 may be urged toward the driving roller 24 by means of a compression spring 40, as is shown schematically in FIG. 6. In this way, the gripping pressure of both rollers 24 and 28 can be established either by combination of the pressure of the spring 40 and that of the air cylinder 26 or only by the pressure of the air cylinder 26 with the spring 40 being omitted.

In the faulty weft processing apparatus equipped with the weft introducing duct 16 having the guide passage 16*a* and the blow guide 19 as shown in FIG. 1, the air stream jetted from the blow nozzle 17 tends to be prevented from dispersing vertically by means of the blow guide 19 and undergoes rectifying action to flow smoothly toward the inlet opening 16*b* of the weft introducing duct 16 after having traversed the weft insertion path. Due to this rectifying action, the jet air stream from the blow nozzle 17 tends to converge toward the inlet opening 16*b* to be easily guided therein. Consequently, the weft Y1 extending from the jet orifice of the weft inserting main nozzle 2 to the cloth feel W1 of the woven fabric W by way of the blow guide 19 is carried toward the inlet opening 16*b* by the rectified air flow or steam, whereby the bent tip portion of the weft Y1 can be guided into the inlet opening 16*b* without failure. The bent tip portion of the weft Y1 introduced forcibly into the guide passage 16*a* in this manner is guided toward the exit 16*c* under the guide action exerted to the jet air stream by the inclined surface 16*d* to be ejected toward the suction duct 21 from the exit 16*c*. In this way, all the weft Y1 wound on the drum 4 is completely withdrawn to be introduced into the weft picking guide 16 until the loom is stopped.

Figure 8:
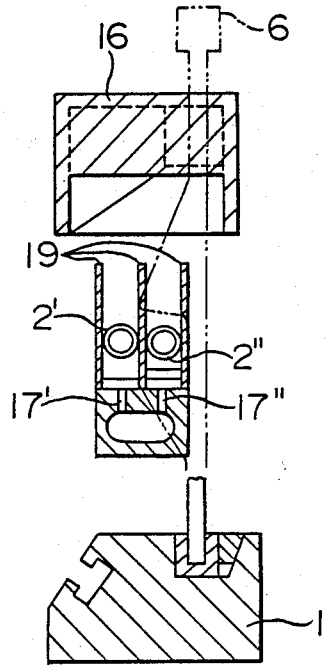
FIG. 8 is a sectional view showing a modification of the arrangement of the weft introducing duct, the blow guide and the blow nozzle shown in FIGS. 6 and 7.

Needless to say, the present invention is never restricted to the embodiments described above. By way of example, it is also possible to insert a plurality of wefts by using plurality of weft inserting means nozzles 2' and 2'', as shown in FIG. 8. In that case, blow nozzles 17' and 17'' jetting respective air streams upwardly may be disposed underneath the weft inserting main nozzles 2' and 2'', respectively, while the weft introducing ducts guide 16 can be disposed in opposition to the blow nozzles 17' and 17'' across the weft inserting path. The blow guides 19 may also be interposed between the blow nozzles 17' and 17'' and the weft introducing duct 16 for the purpose of rectifying upwardly the jet streams from both nozzles 17' and 17''. As the weft cutter for removal of the weft, an electromagnetically driven cutter may be installed. Further, the paired rollers 24 and 28 serving as the weft withdrawing or take over means may be replaced by a wind-up unit. Besides, for preventing formation of the barred upon stoppage of the loom exclusive of the stoppage for disposing of the faulty weft insertion, the present invention can equally be applied for removing the weft inserted immediately before the stoppage of the loom.

Figure 9:
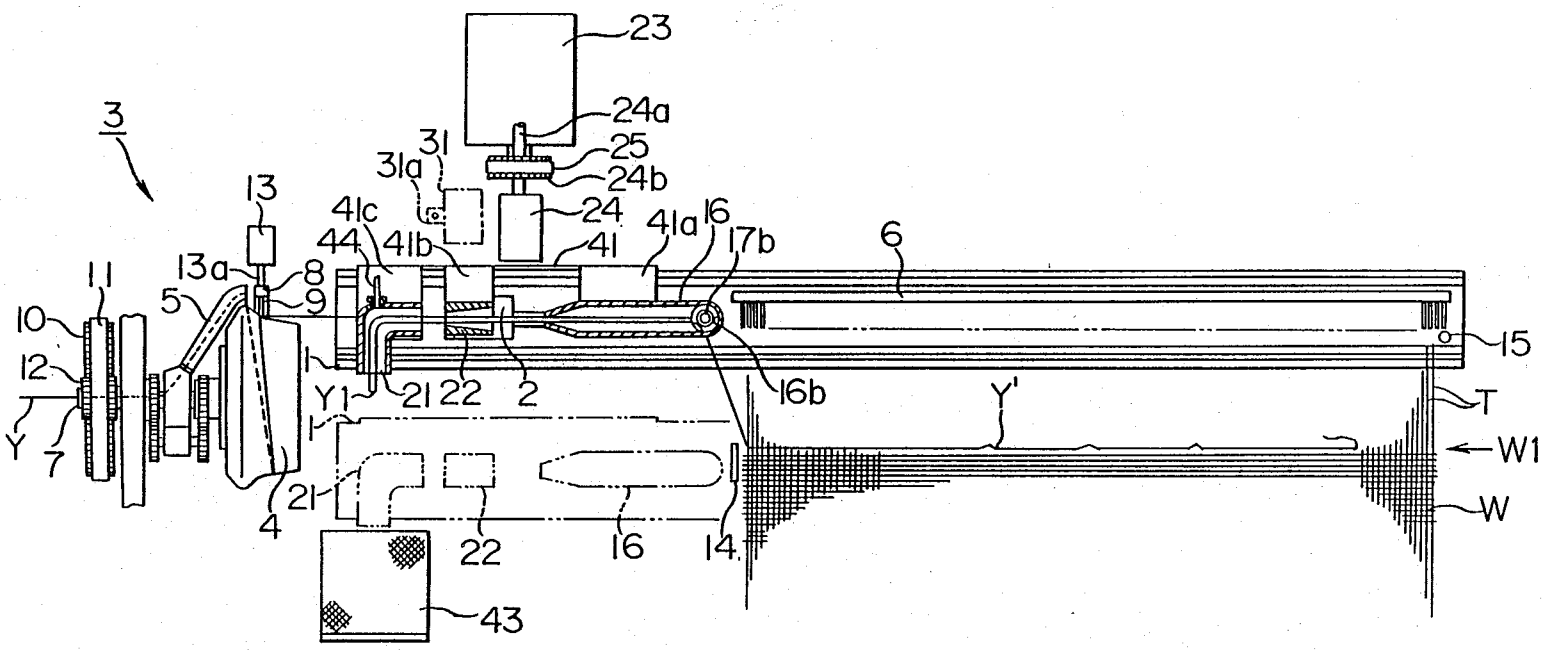
FIG. 9 is a schematic plan view showing partially in section another embodiment of the faulty weft processing apparatus according to the present invention.
Figure 10:
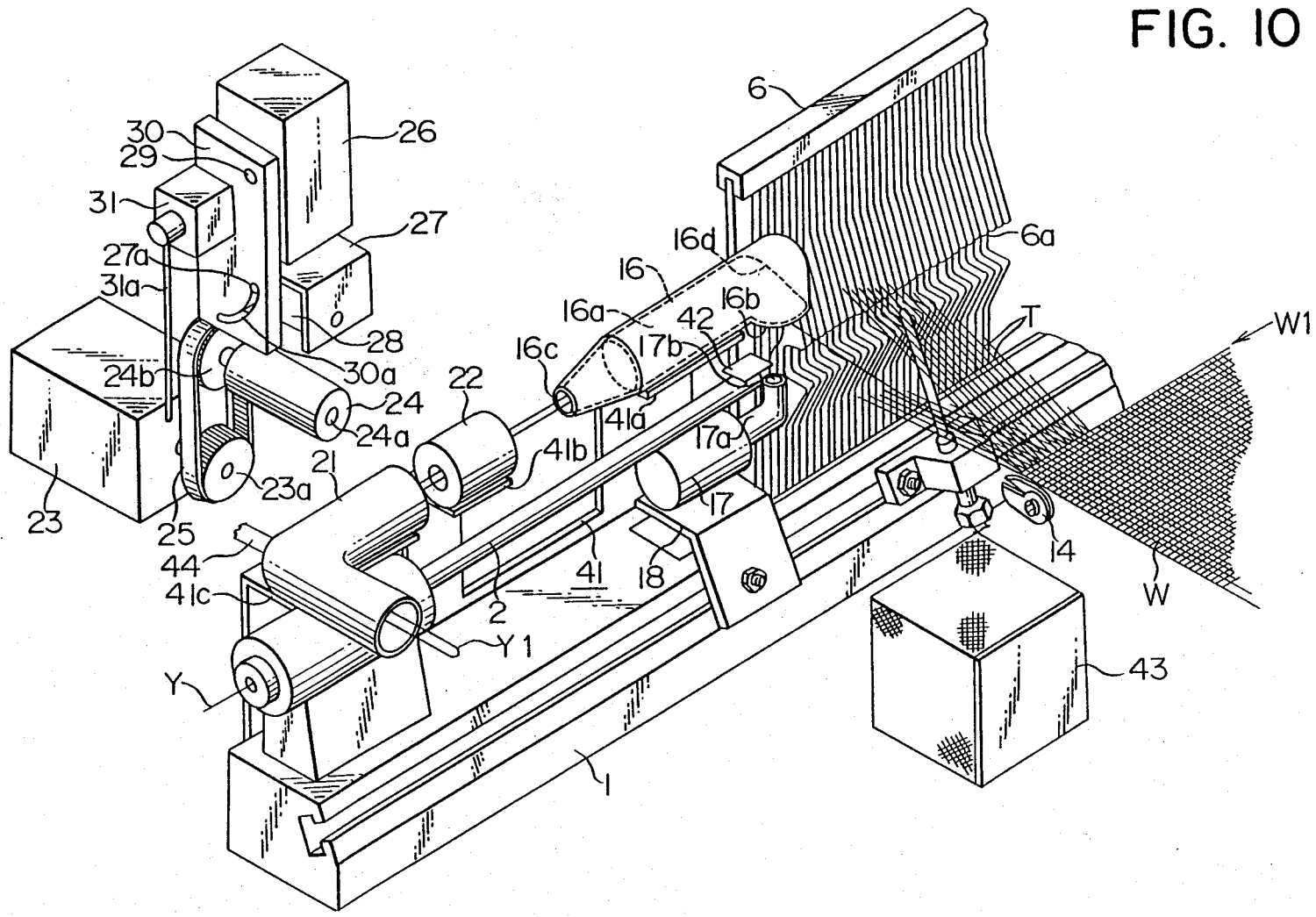
FIG. 10 is a perspective view showing a main portion of the faulty weft processing apparatus of FIG. 9 as it appears in the course of inertial operation of the loom.
Figure 11:
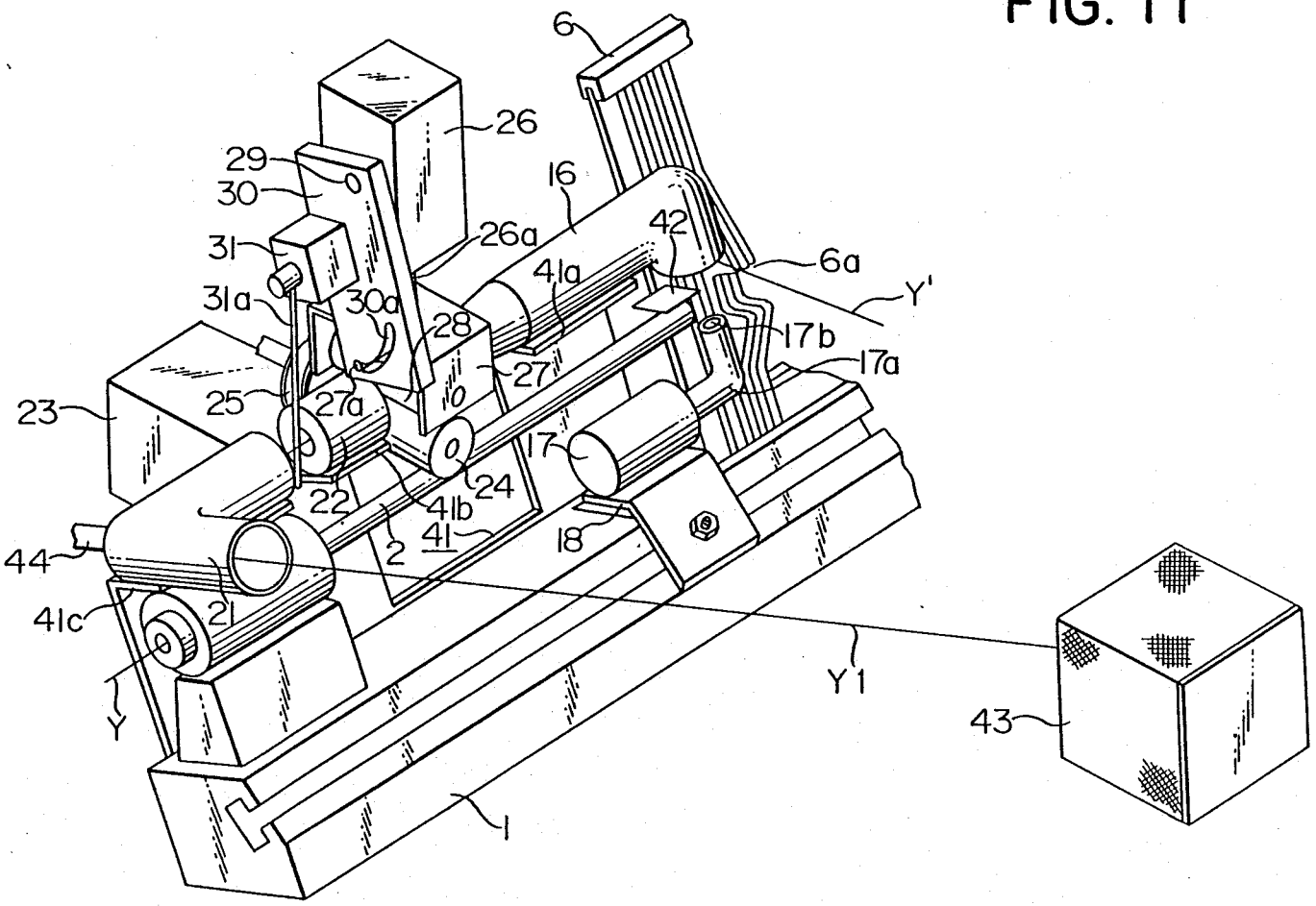
FIG. 11 is a partial perspective view showing the state in which a weft is gripped by a pair of rollers in the faulty weft processing apparatus shown in FIG. 9.

Next, another preferred embodiment of the invention will be described by reference to FIGS. 9 to 11, being understood that description of parts same as or corresponding to those of the preceding embodiments is simplified or omitted. Referring to FIGS. 9 to 11, a blow nozzle 17 fixedly mounted on a supporting base 18 is so disposed that the jet orifice 17*b* formed in a jet tube 17*a* constituting the nozzle is directed toward the jet path of an upper weft inserting nozzle 2.

Fixedly mounted on the rear surface of the sley 1 disposed immediately below the weft inserting main nozzle 2 is a trifurcated supporting member 41 whose supporting arms 41*a*, 41*b* and 41*c* have respective end portions extending in a bent form over the weft inserting main nozzle 2. A weft introducing duct 16 is mounted on the tip portion of the first supporting arm 41*a* with the inlet port of the duct 16 being bent downwardly. More specifically, the inlet port 16*b* of the weft introducing duct 16 is disposed in opposition to the jet orifice 17*b* of the blow nozzle 17 across the jet path of the weft inserting main nozzle 2, while a blade assembly 42 is interposed between the inlet port 16*b* and the jet orifice of the weft inserting main nozzle 2, the blade assembly 42 serving to cut the weft Y1 placed under tension as the weft Y1 is withdrawn by the paired rollers 24 and 28. An air guide 22 is mounted on the second supporting arm 41*b* at the tip portion thereof, while a suction pipe 21 is mounted on the third supporting arm 41c. The entrance and exit of the air guide 22 and the entrance of the suction pipe 21 are disposed on the ejection path extending from the exit 16c of the weft introducing duct 16. The exit end portion of the suction pipe 21 is bent toward a dust box 43 disposed in front of the region within which the sley 1 can swing, wherein a nozzle 44 connected to a pressurized air supply source is connected to the bent portion in such a disposition as to confront the exit of the suction pipe.

Mounted on the loom frame behind the swinging region of the sley 1 is a stepping motor 23 immediately above which a driving roller 24 is disposed, wherein a driving pulley 23a of the stepping motor 23 is operatively connected to a driven pulley 24b mounted on a supporting shaft of the driving roller 24 through the medium of a timing belt 25. An air cylinder 26 is mounted immediately above the driving roller 24 with the longitudinal axis thereof extending vertically and includes a driving rod 26a having a free end portion on which a supporting frame 27 is fixedly mounted and supports rotatably a driven roller 28 in opposition to the driving roller 24 so as to bear against the driving roller 24 under pressure upon actuation of the air cylinder 26. A supporting plate 30 is rotatably suspended by a supporting shaft 29 protruding laterally from the air cylinder 26 and has a guide hole 30a formed therein at a lower end portion in which a guide pin 27a is fittingly and slidably received. Further, the supporting plate 30 is provided with a weft detector 31 having a detecting arm 31a.

The positional relationship between the jet orifice 17b of the blow nozzle 17 and the inlet opening 16b of the weft introducing duct 16 which are disposed invariably in the relative position with the jet path or weft inserting path extending therebetween makes it possible to decrease the distance between the jet orifice 17b and the inlet opening 16b without presenting any obstacle to the weft inserting operation. Accordingly, diffusion of the air jet produced between the jet orifice 17b and the inlet opening 16b can be suppressed to a possible minimum, whereby the jet air stream can wholly flow into the guide passage 16a without being diffused laterally. Thus, a weft Y1 succeeding to the the faulty weft Y' can be forcibly introduced to the inlet port 16b positively notwithstanding of the operation of the loom under inertia. The positivity thus insured allows the weft introducing duct 16 to be implemented in a reduced size, which in turn means that the overall weight of the sley 1 inclusive of the components mounted thereon can be decreased to great advantage for attaining a high speed operation.

Figure 12:
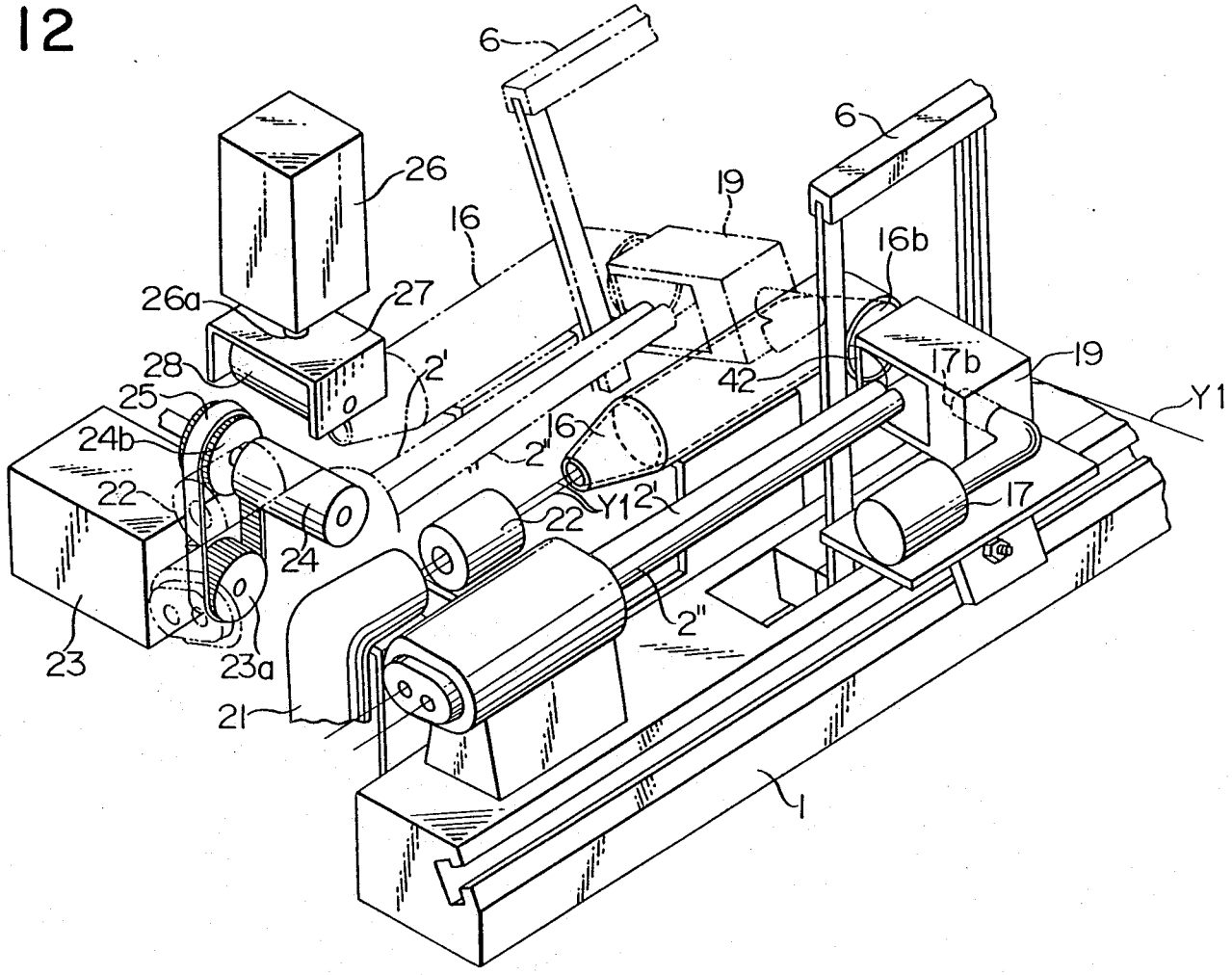
FIG. 12 is a perspective view showing a main portion of a modification of the faulty weft processing apparatus shown in FIGS. 9 to 11.
Figure 13:
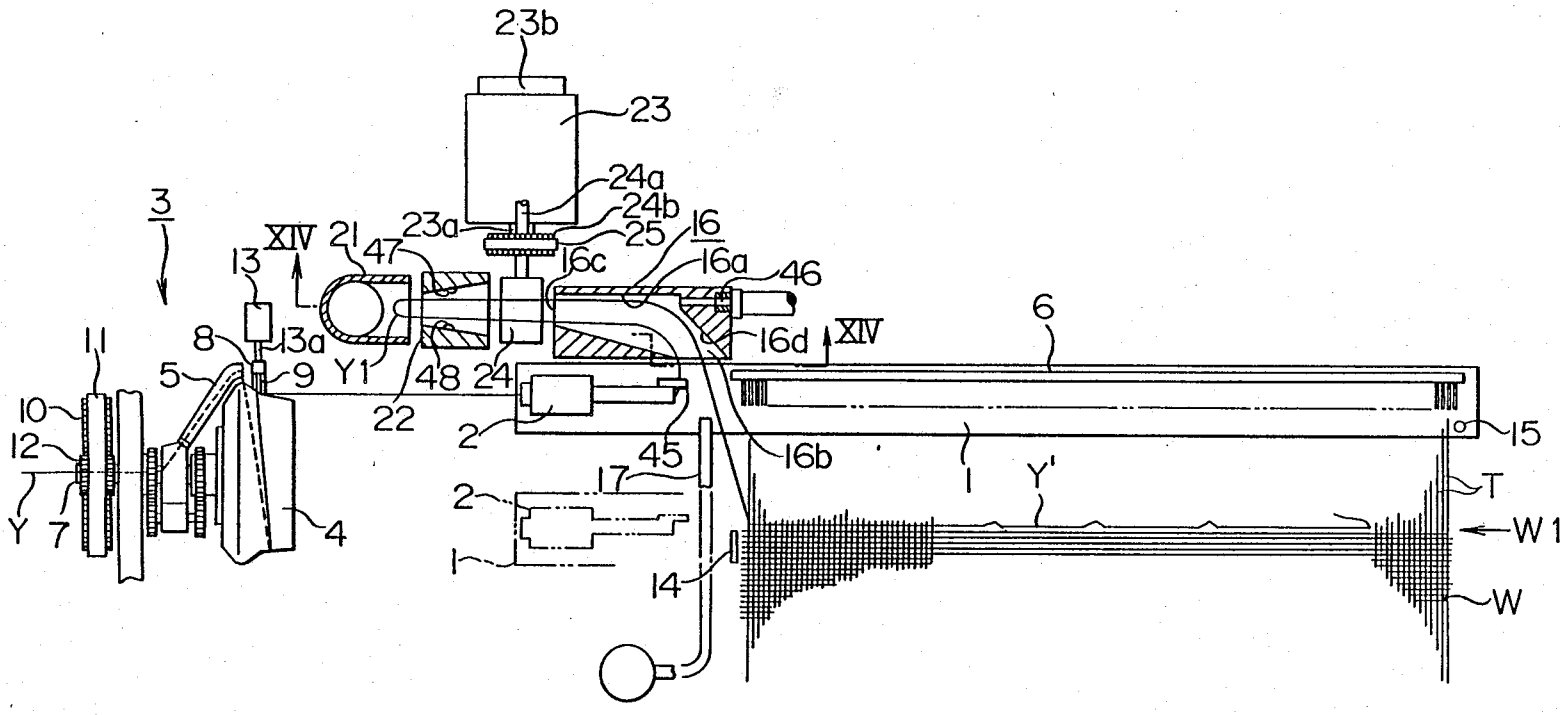
FIG. 13 is a schematic plan view showing partially in section a further embodiment of the faulty weft processing apparatus according to the present invention.
Figure 14:
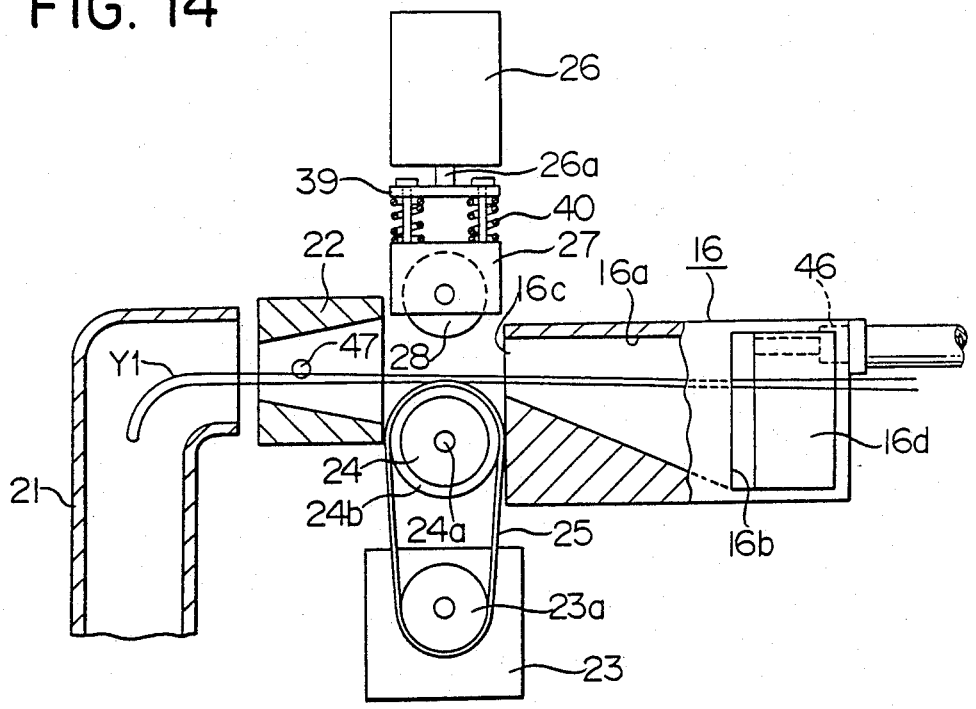
FIG. 14 is an enlarged sectional view taken along a line VII—XII in FIG. 13.

Of course, the present invention is not restricted to the embodiment described just above. By way of example, the blow nozzle 17 may be disposed in front of the weft inserting main nozzles 2' and 2'' (as viewed in the swinging direction of the sley 1 in FIG. 12) with the weft introducing duct 16 being disposed between and behind the weft inserting main nozzles 2' and 2'' (with respect to the swinging direction of the sley 1), wherein the jet orifice 17b of the blow nozzle 17 and the inlet port 16b of the weft introducing duct 16 may be disposed across the jet paths of the weft inserting main nozzles 2' and 2'' at positions invariable relative to the weft inserting main nozzles 2' and 2''. In this case, the weft entering the weft introducing duct 16 can positively be transferred to the paired rollers 24 and 28 serving for the mechanical withdrawing or taking-up function, as in the case of the preceding embodiments. The blow guide 19 mounted on the blow nozzle 17 at the free end portion thereof is provided with a blade 42 for eliminating the weft by cutting in cooperation with the withdrawing action of the paired rollers 24 and 28. Detection of the weft withdrawn to the weft introducing duct 16 may be realized by an optical sensor (not shown) mounted within the air guide 22 or alternatively by a mechanical means such as the detecting arm 31a (FIG. 10).

FIGS. 13 to 16 shows still another embodiment of the present invention. Referring to the figures, a first blow nozzle 17 connected to a blower unit is disposed on the sley 1 in opposition to a weft introducing duct 16 across the weft insertion path defined by the weft inserting main nozzle 2, whereby an air stream flowing into the inlet port 16b transversely of the weft inserting path is produced upon actuation of the blower unit. The weft ejected from the weft inserting main nozzle 2 can be guided into the weft introducing duct 16 under the action of air stream produced between the blow nozzle 17 and the weft introducing duct 16, wherein the weft inserted through blowing into the weft introducing duct 16 can be separated from the weft inserting main nozzle 2 by an electromagnetically driven weft cutter apparatus 45 mounted on the free end of the weft inserting main nozzle 2.

An inclined guide face 16d is formed on the rear wall of the guide passage 16a in the vicinity of the inlet port 16b disposed in opposition to the blow nozzle 17 so that the air jetted from the blow nozzle 17 can be guided toward the exit 16c of the weft introducing duct 16 under the guiding action of the guide surface 16d. Disposed at a rear edge of the guide surface 16d is a second blow nozzle 46 at the same height position as the outlet or exit 16c, which nozzle 46 faces toward the exit 16c . The blow nozzle 46 is connected to the blow unit mentioned above.

In the faulty weft processing apparatus including the blow nozzle 46, the weft Y1 forcibly introduced into the guide passage 16a is entrained toward the outlet 16c by the air stream ejected from the second blow nozzle 46 disposed within the weft introducing duct 16, whereby the bent free end portion of the weft Y1 is ejected into the suction duct 21 from the outlet 16c. The air stream jetted from the second blow nozzle 46 generates an attendant air stream in the vicinity of the inlet port 16b and the inclined guide surface 16d. The attendant air flows exerts sucking action to the weft Y1 in the vicinity of the inlet port 16b. Further, since the air blown onto the weft Y1 is deflected toward the exit or outlet port 16c under the action of the inclined surface 16d, the weft Y1 introduced into the inlet port 16d is smoothly transferred to the air stream ejected from the blow nozzle 46 through cooperation of the reflected guided to the outlet port 16c.

Figure 15:
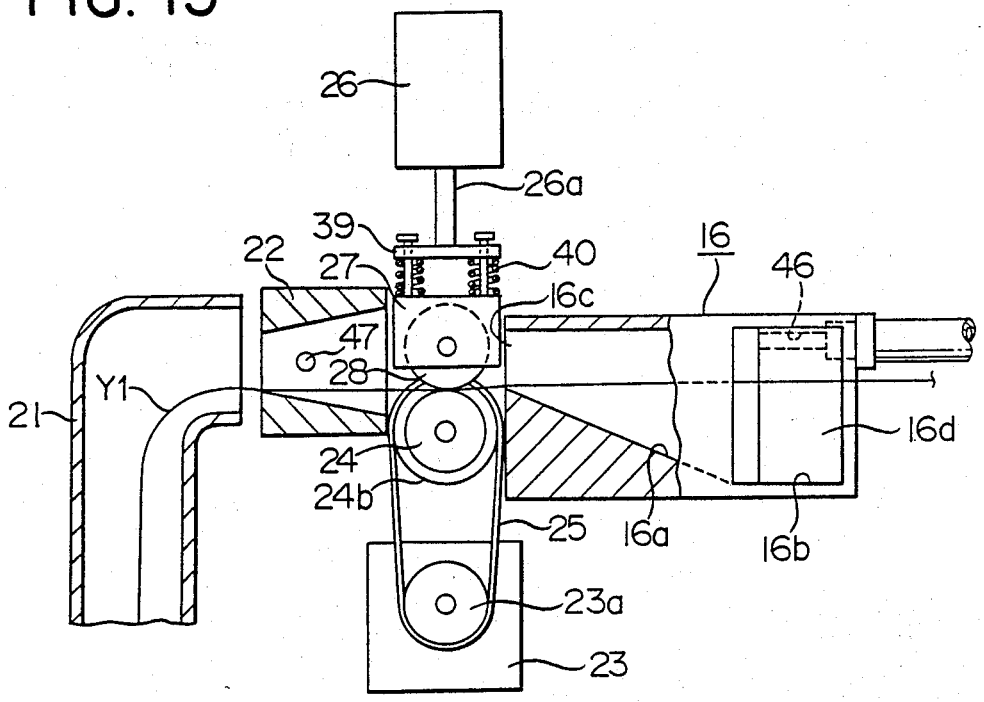
FIG. 15 is a view similar to FIG. 14 and shows the state in which a driving roller constituting a part of the weft take-over means is brought into contact with a counterpart driven roller.
Figure 16:
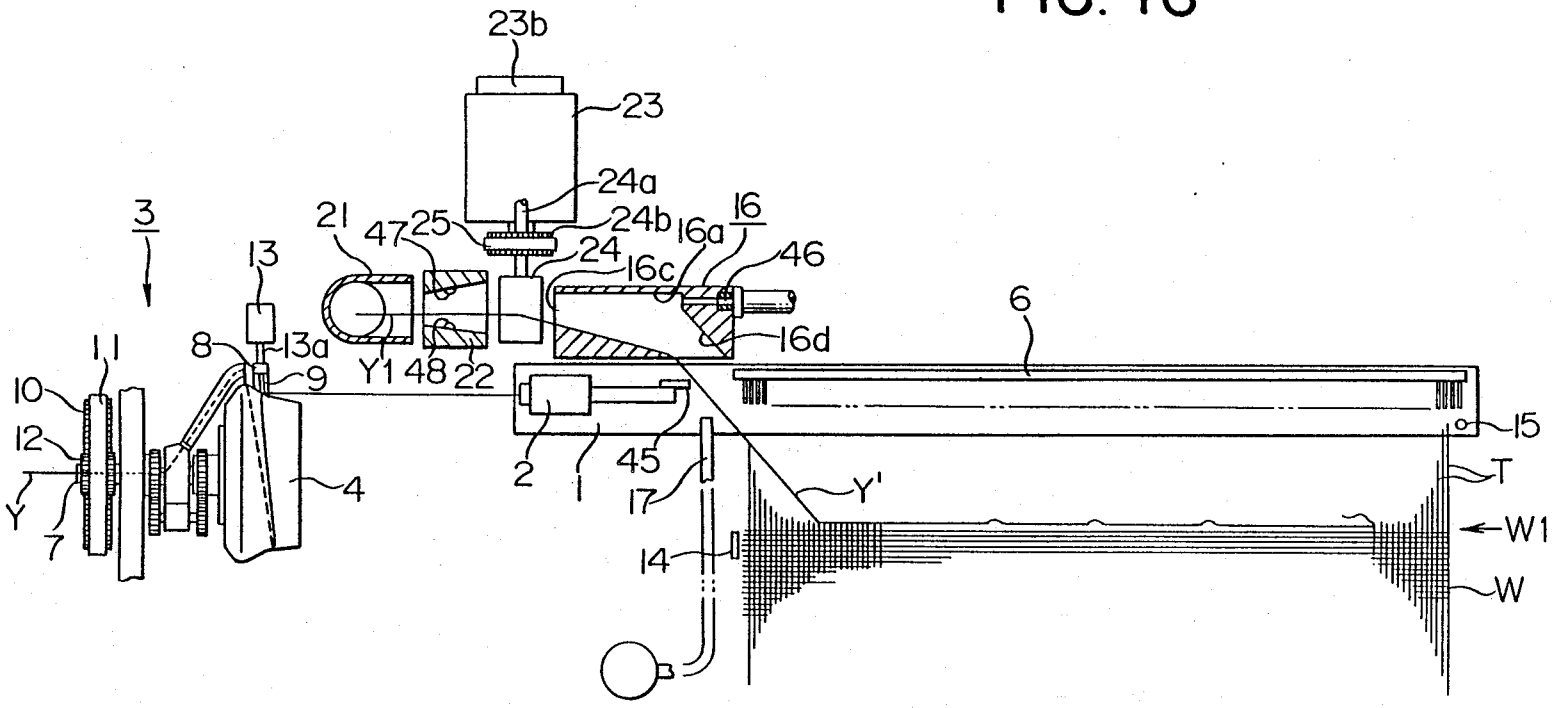
FIG. 16 is a view similar to FIG. 13 and shows a state in which a faulty weft is being withdrawn.

When the bent free end portion of the weft Y1 ejected from the outlet port 16c has reached the air guide 22, the weft Y1 is detected by the weft detector composed of a light projecting element 47 and a light receiving element 48. On the basis of the detection signal thus produced, the motor 23, the air cylinder 26 and the weft cutter 45 for the removal of the weft are put into operation. Consequently, the weft Y1 is separated by cutting from the weft inserting main nozzle 2, as is shown in FIG. 15. At the same time, the driven roller 28 is pressed against the rotating driving roller 24, resulting in that the weft Y1 is gripped between the rollers 24 and 28 with the latter starting rotation. As the weft Y1 is withdrawn toward the suction duct 21 through rotation of the rollers 24 and 28, the faulty weft Y' is separated from the cloth fell W1, as is illustrated in FIG. 16. In other words, the feeding action of the air stream for forcibly feeding the succeeding weft Y1 into the weft introducing duct 16 which weft Y1 provides a clue for enabling the withdrawal of the faulty weft Y; from the cloth fell W1 is transferred from the blow nozzle 17 to the entraining action of the air stream jetted from the blow nozzle 46, whereby the weft Y1 is moved to the position to be mechanically withdrawn by the rotating driving roller 24 and the driven roller 28. The mechanical weft gripping by the paired rollers 24 and 28 is positively realized, whereby the withdrawal or removal of the faulty weft Y' located on the cloth fell can be carried out with high ratio success.

With the arrangement of the instant embodiment, the amount of the weft as withdrawn can be measured accurately by the combination of the light emitting element 47, the light receiving element 48 and an rotary encoder 23*b*, whereby decision as to whether the faulty weft Y' could be successfully withdrawn or not can be made on the basis of the result of this measurement. In other words, so far as the amount of withdrawal falls within the preset range, it is decided that the perfect withdrawal of the faulty weft Y' is realized. On the other hand, unless the amount of the weft as withdrawn is out of the range mentioned above, it is expected that breakage of the weft in the course of the withdrawal or during the insertion takes places, whereby the faulty weft Y' remains to be removed. Consequently, the loom is prevented from being restarted with the faulty weft Y' being left as it is. In this manner, the defective weaving can be satisfactorily evaded.

Figure 17:
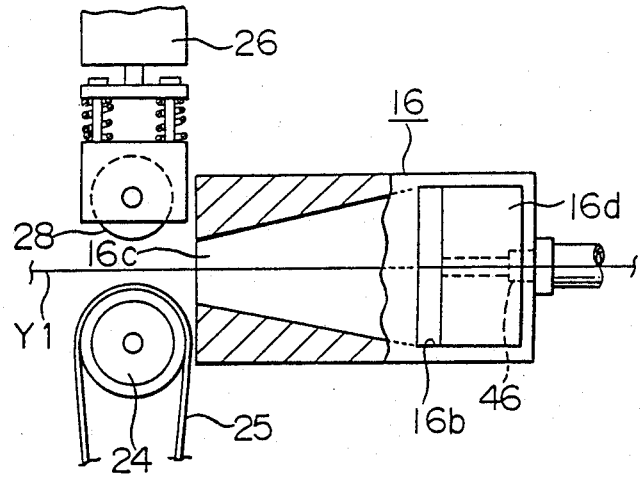
FIGS. 17 to 19 are sectional views showing various modifications of the structure or arrangement associated with the weft introducing duct shown in FIG. 13, respectively.
Figure 18:
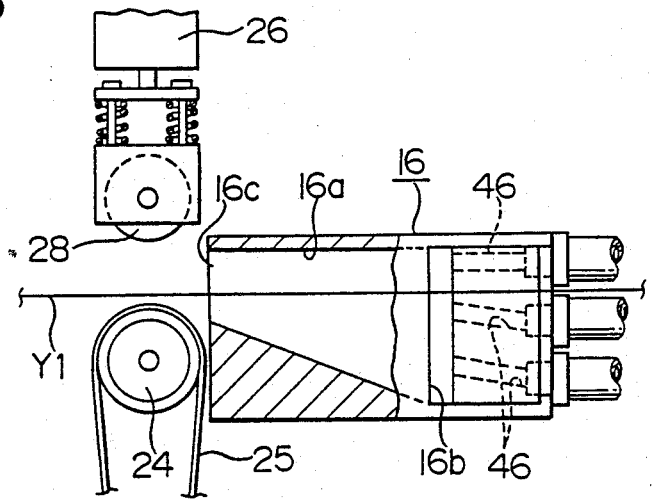
Figure 19:
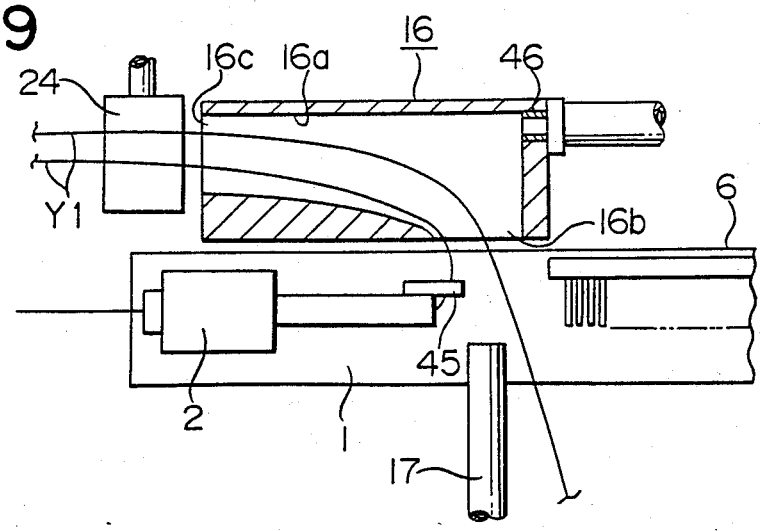

Needless to say, the present invention is not restricted to the embodiment described above. By way of example, the outlet port 16*c* may be positioned at a vertically center position of the weft introducing duct 16, while the exit orifice of the blow nozzle 46 may be positioned at the same height as the exit 16*c*, as is shown in FIG. 17. Further, a plurality of blow nozzles 46 facing toward the outlet or exit 16*c* may be installed within the weft introducing duct 16, as is shown in FIG. 18. The inclined guide surface 16*d* may be omitted, as will be seen in FIG. 19.

It is thought that the present invention will be understood from the foregoing description and it will be apparent that various changes may be made in the form, construction and arrangement thereof without departing from the spirit and scope of the invention or sacrificing all of its material advantages, the forms hereinbefore described being merely preferred or exemplary embodiments thereof.

What I claim is

1. A method for disposing of a faulty weft appearing during operation of a fluid jet loom, comprising the steps of:

detecting a misinserted weft in a weft insertion path before said misinserted weft is beat into the fell and cut from the yarn supply, upon detecting a misinserted weft, deenergizing the loom while maintaining jet fluid power and preventing the cutting of said misinserted weft from said yarn supply which cutting would otherwise occur as inertia causes the loom to continue motion;

blowing into a duct, disposed laterally of the normal weft insertion path, the length of yarn that would otherwise become the next succeeding weft after the detected misinserted weft, and carrying said length of yarn over a take-over path to take-over means including stepping-motor-driven rollers for positive transport of said yarn;

operating said stepping motor a predetermined number of steps and cutting from the yarn supply said length of yarn; and thereafter determining if said misinserted weft was properly withdrawn by detecting whether yarn is present within said take-over path.

2. A method for disposing of a faulty weft according to claim 1, wherein said laterally disposed duct is disposed with its axis substantially parallel to said normal weft insertion path such that said operating of said stepping motor withdraws said misinserted weft from a warp shed along a path that is substantially parallel to said normal weft insertion path.

3. An apparatus for disposing of a faulty weft appearing during operation of a fluid jet loom, wherein a weft is inserted by a jet of fluid from a weft inserting main nozzle over a weft insertion path through a shed formed by warps, and the inserted weft, upon beating to a cloth fell, is cut by cutter means to separate said inserted weft from said main nozzle, said apparatus comprising:

means for detecting a misinserted weft in said weft insertion path before said misinserted weft is beat into the fell and separated from said main nozzle;

means for deenergizing said loom while maintaining jet fluid power;

means operative upon said deenergizing of said loom for preventing operation of said cutter means as inertia causes continued loom motion and beating of said misinserted weft;

a duct disposed laterally of said main nozzle and having inlet and outlet ports at opposite ends of a passage;

take-over means for positive transport of yarn introduced through said duct, said take-over means comprising a pair of selectively engageable rollers for gripping therebetween the yarn introduced through said duct, and a stepping motor operatively coupled to one of said rollers for driving thereof;

second cutter means for separating from said main nozzle said yarn introduced through said duct; and yarn detecting means including a detecting arm movable upon engagement of said rollers to sweep across the path followed by yarn transported by said rollers.

4. An apparatus for disposing of a faulty weft according to claim 3, wherein said inlet port in said duct is shaped so as to be inclined relative to said weft insertion path within a region in which the warps forming the shed remain out of contact with the weft being introduced and to restrict a weft withdrawing path to a direction away from the cloth fell.

5. An apparatus for disposing of a faulty weft according to claim 3 further comprising a blow nozzle for blowing into said duct and through said passage the length of yarn ejected from said main nozzle that would otherwise become the next succeeding weft after the detected misinserted weft.

6. An apparatus for disposing of a faulty weft according to claim 5, further comprising a blow guide disposed between said duct and said blow nozzle across said weft insertion path.

7. An apparatus for disposing of a faulty weft according to claim 5, wherein a jet orifice of said blow nozzle and said inlet port of said duct are disposed on opposite sides of said weft insertion path in fixed position relative to said main nozzle, and said take-over means is disposed on a stationary portion of said loom.

8. An apparatus for disposing of a faulty weft according to claim 5, further including a second blow nozzle disposed in said duct and oriented toward said take-over means.

* * * * *

UNITED STATES PATENT AND TRADEMARK OFFICE

CERTIFICATE OF CORRECTION

PATENT NO. : 4,890,650

DATED : January 2, 1990

INVENTOR(S) : K. Mitsuya

It is certified that error appears in the above-identified patent and that said Letters Patent is hereby corrected as shown below:

Col. 3, line 14, after "weft" insert comma --,--;

Col. 5, line 14, after "taking" insert hyphen -- - --; line 30, delete "in", insert --on--; line 46, delete "thee", insert --the--;

Col. 6, line 9, delete "o", insert --of--;

Col. 7, line 8, delete "VII", insert --XII--; line 50, delete "sychronism", should read --synchronism--; line 61, delete "13", insert --13a--;

Col. 8, line 50, delete "t16" insert --16--; line 68, delete "in", insert --into--;

Col. 9, line 24, delete "26", insert --24--;

Col. 10, line 4, delete "ing", insert --ion--; line 55, delete "tion g", insert --ting--;

Col. 11, line 26, "present", should read --preset--;

Col. 13, line 36, "barred" should read --barre--; line 47, "inelt" should read --inlet--; line 47, "crosssection" should read --cross-section--;

Col. 14, line 9, "steam" should read --stream--; line 22, after "using" insert --a--; line 22, "means" should read --main--; line 37, "barred" should read --barre--;

UNITED STATES PATENT AND TRADEMARK OFFICE

CERTIFICATE OF CORRECTION

PATENT NO. : 4,890,650

DATED : January 2, 1990

INVENTOR(S) : K. Mitsuya

It is certified that error appears in the above-identified patent and that said Letters Patent is hereby corrected as shown below:

Col. 15, line 47, "insured" should read --ensured--;

Col. 16, line 55, after "reflected" insert --air stream and the attendant air flow, whereby the weft Y1 is positively--

Col. 17, line 8, "Y;" should read --Y'--

Signed and Sealed this

Twenty-third Day of April, 1991

*Attest:*

*Attesting Officer*

HARRY F. MANBECK, JR.

*Commissioner of Patents and Trademarks*